US010323439B2

(12) United States Patent
Liang et al.

(10) Patent No.: US 10,323,439 B2
(45) Date of Patent: Jun. 18, 2019

(54) METHOD OF SECURING A SASH WINDOW AND DOOR FOR TRANSPORT

(71) Applicant: Vision Industries Group, Inc., So. Plainsfield, NJ (US)

(72) Inventors: Luke Liang, So. Plainsfield, NJ (US); David Chen, Guangzhou (CN)

(73) Assignee: Vision Industries Group, Inc., Secaucus, NJ (US)

( * ) Notice: Subject to any disclaimer, the term of this patent is extended or adjusted under 35 U.S.C. 154(b) by 715 days.

(21) Appl. No.: 14/723,742

(22) Filed: May 28, 2015

(65) Prior Publication Data

US 2015/0337563 A1 Nov. 26, 2015

Related U.S. Application Data

(63) Continuation of application No. 13/938,338, filed on Jul. 10, 2013, now Pat. No. 9,127,486, which is a (Continued)

(51) Int. Cl.
*E05B 65/08* (2006.01)
*E05B 67/00* (2006.01)
(Continued)

(52) U.S. Cl.
CPC ..... *E05B 65/0894* (2013.01); *E05B 67/003* (2013.01); *E05D 13/00* (2013.01);
(Continued)

(58) Field of Classification Search
CPC ..... E05C 17/54; E05C 19/007; E05C 19/008; E05C 19/18; E05C 19/182; E05C 19/188;
(Continued)

(56) References Cited

U.S. PATENT DOCUMENTS 771,331 A 10/1904 Spector
777,342 A * 12/1904 Homer ..... E05C 19/182 292/296
(Continued)

FOREIGN PATENT DOCUMENTS

GB 163530 A * 5/1921 ..... E05C 17/54
WO WO-2005116374 A1 * 12/2005 ..... E05B 65/0025
(Continued)

*Primary Examiner* — Christine M Mills
(74) *Attorney, Agent, or Firm* — Thomas A. O'Rourke; Bodner & O'Rourke, LLP

(57) ABSTRACT

A clip assembly may safely secure sliding sashes of a window or door during transportation, and, in one embodiment, be comprised of a strap member and a pawl member. The strap member may be comprised of a bumper portion, and a strap portion extending therefrom, where the strap portion may have a plurality of teeth formed within the thickness of the strap. The pawl member may have a pair of sidewalls supported by a top wall and an intermediate wall. The top wall may have a protrusion which includes a plurality of pawl teeth formed to complement the strap teeth, and be located proximate to the intermediate wall. The strap may be introduced through the gap between the top rail of an upper sash and bottom rail of the second sash, to then be inserted into the pawl, and thereby be retained by the respective teeth to secure the sashes.

2 Claims, 20 Drawing Sheets

Related U.S. Application Data continuation-in-part of application No. 12/657,667, filed on Jan. 25, 2010, now abandoned.

(60) Provisional application No. 61/284,244, filed on Dec. 15, 2009.

(51) Int. Cl.
*E05D 13/00* (2006.01)
*E06B 7/00* (2006.01)

(52) U.S. Cl.
CPC ..... *E05D 13/003* (2013.01); *E06B 7/00* (2013.01); *E05Y 2600/60* (2013.01); *E05Y 2800/696* (2013.01); *E05Y 2900/148* (2013.01); *Y10T 24/2175* (2015.01); *Y10T 24/45246* (2015.01)

(58) Field of Classification Search
CPC ..... E05B 15/1635; E05B 17/0012; E05B 65/0894; E05B 67/003; Y10S 292/38; Y10T 292/48; Y10T 292/505; Y10T 292/17; Y10T 292/34; Y10T 292/71; Y10T 292/73; Y10T 24/2175; Y10T 24/45246; E05Y 2800/696
USPC ..... 292/307 R, 325, 253, 288, 342, 343, 292/DIG. 38; 24/68 R, 16 PB
See application file for complete search history.

(56) References Cited

U.S. PATENT DOCUMENTS 1,173,998 A 2/1916 Depew
1,278,779 A 9/1918 Springer
1,695,872 A * 12/1928 White, Jr. ..... B60J 1/2097 16/DIG. 6
1,970,879 A * 8/1934 Bell ..... E05C 17/54 16/DIG. 6
2,029,569 A * 2/1936 Jones ..... E05B 65/0894 292/288
2,171,448 A 8/1939 Holtz
2,759,390 A 8/1956 Edwards
2,878,663 A * 3/1959 Smith ..... E05B 65/0894 70/14
2,935,773 A 5/1960 Weckesser
2,936,980 A 5/1960 Rapata
2,969,216 A 1/1961 Hallsey
2,977,145 A 3/1961 Rifkin
3,009,220 A * 11/1961 Fein ..... B65D 63/1072 24/16 PB
3,102,311 A 9/1963 Martin
3,127,648 A 4/1964 Emery
3,224,056 A 12/1966 Joffe
3,368,247 A 2/1968 Orban
3,556,575 A * 1/1971 Farkas ..... B65D 63/1036 24/16 PB
3,570,497 A * 3/1971 Lemole ..... A61B 17/04 24/16 PB
3,605,199 A * 9/1971 Eberhardt ..... B65D 63/1072 24/16 PB
3,900,923 A * 8/1975 Thomas ..... B65D 63/1072 24/16 PB
3,938,839 A * 2/1976 Collier ..... E05B 65/0894 292/258
4,537,432 A * 8/1985 Meeks ..... G09F 3/037 24/16 PB
4,617,810 A * 10/1986 Fish ..... E05B 65/0894 70/14
4,688,302 A * 8/1987 Caveney ..... B65D 63/1072 24/16 PB
4,727,630 A * 3/1988 Alan ..... A44B 11/06 24/593.11
4,932,100 A * 6/1990 Flowers ..... E05F 7/04 16/82
5,031,943 A * 7/1991 Scott ..... B65D 63/1081 24/16 PB
5,123,686 A * 6/1992 Wenk ..... B65D 63/1072 24/16 PB
5,125,699 A * 6/1992 Dinan ..... E05B 65/0894 292/288
5,340,176 A * 8/1994 Cresci ..... E05B 65/0888 292/343
5,416,952 A 5/1995 Dodge
5,462,542 A * 10/1995 Alesi, Jr. ..... A61B 17/823 24/16 R
5,480,176 A 1/1996 Sims
5,542,723 A * 8/1996 Scharf ..... E05C 17/54 292/258
5,852,852 A 12/1998 Rigal
5,890,265 A * 4/1999 Christian ..... B65D 63/1072 24/16 PB
6,185,791 B1 * 2/2001 Khokhar ..... B65D 63/1063 24/16 PB
6,219,889 B1 * 4/2001 Lovato ..... A44B 11/12 24/170
6,343,436 B1 * 2/2002 Milano, Jr. ..... E05F 15/665 49/139
6,347,434 B1 * 2/2002 Newman ..... B65D 63/1063 24/16 PB
6,347,435 B1 * 2/2002 Davignon ..... B65D 63/1063 24/16 PB
6,347,817 B1 * 2/2002 Chou ..... B60P 7/15 248/230.6
6,513,842 B1 * 2/2003 Fuehrer ..... G09F 3/0317 292/307 R
6,684,667 B2 * 2/2004 Young ..... A41F 1/008 70/18
6,789,341 B1 * 9/2004 Badura ..... F41A 17/44 128/876
6,807,714 B2 * 10/2004 O'Young ..... B65D 63/1072 24/16 PB
6,981,725 B2 * 1/2006 Debrody ..... B65D 63/1063 24/16 PB
7,100,248 B2 * 9/2006 Crook ..... B65D 63/1018 24/16 PB
7,229,052 B2 * 6/2007 Takeuchi ..... F16B 21/088 24/16 PB
7,774,905 B2 * 8/2010 Geiger ..... F16L 3/2332 24/16 PB
7,997,542 B2 * 8/2011 Morello ..... F16L 3/13 24/16 PB
8,146,211 B2 * 4/2012 Shirai ..... A41F 1/008 24/16 PB
8,328,146 B2 * 12/2012 Yeh ..... H02G 3/30 24/16 PB
8,510,918 B2 * 8/2013 Shilale ..... B65D 63/1072 24/16 PB
8,516,660 B2 * 8/2013 Ku ..... B65D 63/1072 24/16 PB
8,578,565 B2 * 11/2013 Hienekamp ..... B65D 63/1072 24/16 PB
8,918,964 B2 * 12/2014 Iwahara ..... B60R 16/0215 24/16 PB
9,021,681 B2 * 5/2015 Owen ..... B65D 63/1081 24/16 PB
2003/0192419 A1 10/2003 Berrocal
2007/0028425 A1 * 2/2007 Mori ..... B29C 45/2628 24/16 PB
2008/0189916 A1 8/2008 Geiger
2010/0281661 A1 * 11/2010 Harada ..... A42B 1/22 24/593.11

(56) References Cited

U.S. PATENT DOCUMENTS

| | | | | |
|---|---|---|---|---|
| 2011/0138589 | A1* | 6/2011 | Liang | E05B 65/0894 24/68 R |
| 2015/0008686 | A1* | 1/2015 | Shearer | E05C 17/54 292/343 |
| 2016/0001945 | A1* | 1/2016 | Foreman | F16L 3/222 29/525.03 |
| 2016/0016709 | A1* | 1/2016 | Dinh | B65D 63/1072 24/16 PB |

FOREIGN PATENT DOCUMENTS

| | | |
|---|---|---|
| WO | WO 2008041688 | 4/2008 |
| WO | WO 2008136660 | 11/2008 |

* cited by examiner

METHOD OF SECURING A SASH WINDOW AND DOOR FOR TRANSPORT

This application is a continuation of U.S. application Ser. No. 13/938,338, filed on Jul. 10, 2013, which is a continuation-in-part of U.S. application Ser. No. 12/657,667, filed on Jan. 25, 2010, which claims priority on U.S. Provisional Application Ser. No. 61/284,244 filed on Dec. 15, 2009, with the disclosures of each being incorporated herein by reference.

FIELD OF THE INVENTION

The present invention relates to improvements in the means for shipping sliding and tiltable sash windows, and more particularly to apparatus which relieve the stresses imposed on the window's sash locks during transportation.

BACKGROUND OF THE INVENTION

There are many different window types available on the market, such as picture windows, bay windows, skylight windows, louvered windows, transom windows, casement windows, and the many versions of the sash window, with those being single-hung, double-hung, vertical sliding, and horizontal sliding sash windows. While the casement window is predominantly used in the United Kingdom and much of Europe, the sliding sash window remains an American favorite for both new construction and for replacement windows.

Many developments made in sliding sash windows are design changes that relate to improved functionality in the manufacture and/or operation of the windows, particularly with respect to its latches and hinges. However, there has been a long-felt, but unmet, need to improve the traditional methods of safely shipping sliding sash windows.

To prevent damage to either or both sashes due to uncontrolled sliding, the windows are normally transported with both sashes being latched. However, because of the bouncing and jarring motion including vibrations that are experienced during its transportation, a great deal of stress is placed on the lock and keepers of the window as well as the screws holding the locks and keepers in place. This stress can cause the locks and keepers to become broken or fractured and may also cause the screws to become dislodged from the sash. Such damage can result whether transportation is accomplished using freight cars on a railroad, or by a tractor-trailer on the nation's highways.

Window manufacturers attempt to address this problem in one of a number of different ways. One way is to insert blocking, made from cardboard, Styrofoam or any number of various different packaging materials, to support the sash windows, while other manufacturers will ship the windows in the closed position but with the sashes unlocked, and with some outer packaging solely relied upon to hold the sashes in place. But this is cumbersome and costly, not only in terms of the purchasing and needed supply of bulky packing materials, but also for its disposal.

Another method is to open the sash window, and to turn and pack the window upside-down. However, this method creates the potential risk of damage to the window sashes and frame from sliding motion, and furthermore makes the window awkward to maneuver and handle. Another solution is to ship the windows closed and locked, and to use air ride type cargo vans and trailers to reduce the stress to the hardware, with a corresponding increase in shipping costs.

This invention provides an economical and simple solution for the transportation of sash windows and doors through the use of a serrated strap. There has been some limited use of serrated straps in the art. In U.S. Pat. No. 5,852,852 to Rigal, it was used in combination with a ratchet locking member as a tightening device, with particular applicability for snowboard bindings, roller skates and the like. The Rigal patent improved upon the prior art use of serrated straps, such as those found, for example, in U.S. Pat. No. 5,480,176 to Sims for an externally mounted binding, as well as the Ratchet-type Buckle shown by U.S. Pat. No. 5,416,952 to Dodge. However, all of these types of devices require the use of a separate pivoting ratchet element in combination with the serrated strap.

U.S. Pat. No. 5,462,542 to Alesi discloses a more simple arrangement in the form of a "Sternum Buckle With Serrated Strap." The Alesi sternum buckle assembly is adapted to be looped about the split portions of tissue. The serrated strap extends outward from the pawl in a single piece that is formed of a bio-absorbable material. Similarly, in U.S. Pat. No. 3,570,497 to Lemole, the strap has a needle end to penetrate tissue, where retention of the serrations are more simply accomplished by a latch collar, and was intended to be used as a fast means of applying a suture. However, none of these approaches are capable of providing support needed for the safe transportation of a sliding sash window or door.

Using this invention allows a sash window or door to be shipped with the sashes in the closed position, while remaining unlocked, thus eliminating stress that causes damage to the lock, keeper, and screws.

OBJECTS OF THE INVENTION

It is an object of the invention to provide a means of safely transporting a sliding sash window or door.

It is another object of the invention to provide a means of safely transporting a sliding sash window or door without the use of bulky packing materials.

It is a further object of the invention to provide a single means of securing a sliding sash window or door that may universally be utilized by different sized windows and doors.

It is another object of the invention to provide a means of securing a sliding sash window or door in the closed position without use of the window's lock and keeper.

It is also an object of the invention to provide a means of securing a sliding sash window or door in the closed position by utilizing the sash window frame.

It is a further object of the invention to provide a means of securing a sliding sash window or door in the closed position without use of the window's lock and keeper, where a quick release of the securing means may be facilitated without the use of a tool.

SUMMARY OF THE INVENTION

The clip assembly of the present invention may be used to secure one or more objects, particularly the sliding sashes of a window or door during transportation, to prevent damage to the sashes or to prevent damage to the locks and corresponding keepers when shipped in the locked condition, as well as to obviate the need of using cumbersome cardboard blocking as a restraint.

The clip assembly may be comprised of two separate molded parts—a strap member and a pawl member. The strap member may be formed to have a bumper portion, and a strap portion extending from the bumper. The bumper may preferably have an engagement wall, and a bottom wall that is supported to be approximately orthogonal to the engagement wall by first and second side walls. The strap portion may have a plurality of teeth formed within the thickness of the strap. The strap teeth may be formed to have an engagement face and a back face, which converge to create a peak, and whereby successive teeth are separated by a trough. Also, the strap portion may terminate in a thinner strap section, with a ramp between the two strap sections, and where the thinner strap section may have a rounded end which may also be ramped to facilitate its insertion into the pawl.

The pawl member may have a pair of sidewalls supported by a top wall and an intermediate wall. The top wall may have a protrusion which includes a plurality of teeth formed to complement the teeth of the strap, and be located proximate to the intermediate wall. The teeth may be located at a distance from the intermediate wall to permit the strap to be trapped there between, once it is inserted. Insertion of the strap may be accomplished whereby the strap causes deflection of the pawl teeth and the protrusion. This required deflection of the pawl teeth and protrusion may be aided by a recess in the intermediate wall to take advantage of the flexible nature of the strap.

To restrain a window for transit by truck or rail, a strap of the current invention may be inserted through the gap between the top rail of an upper sash and the bottom rail of the second sash, and then be inserted into the pawl, such that engagement edges of the first and second side walls of the pawl abuts the top rail of the bottom sash. Insertion of the strap into the pawl may occur by inserting the free end of the strap portion into the gap between the strap teeth and the intermediate wall, to engage the pawl teeth until the engagement edge of the first and second side walls of said pawl member firmly contacts the bottom rail of said second sash.

DETAILED DESCRIPTION OF THE INVENTION

Figure 1:
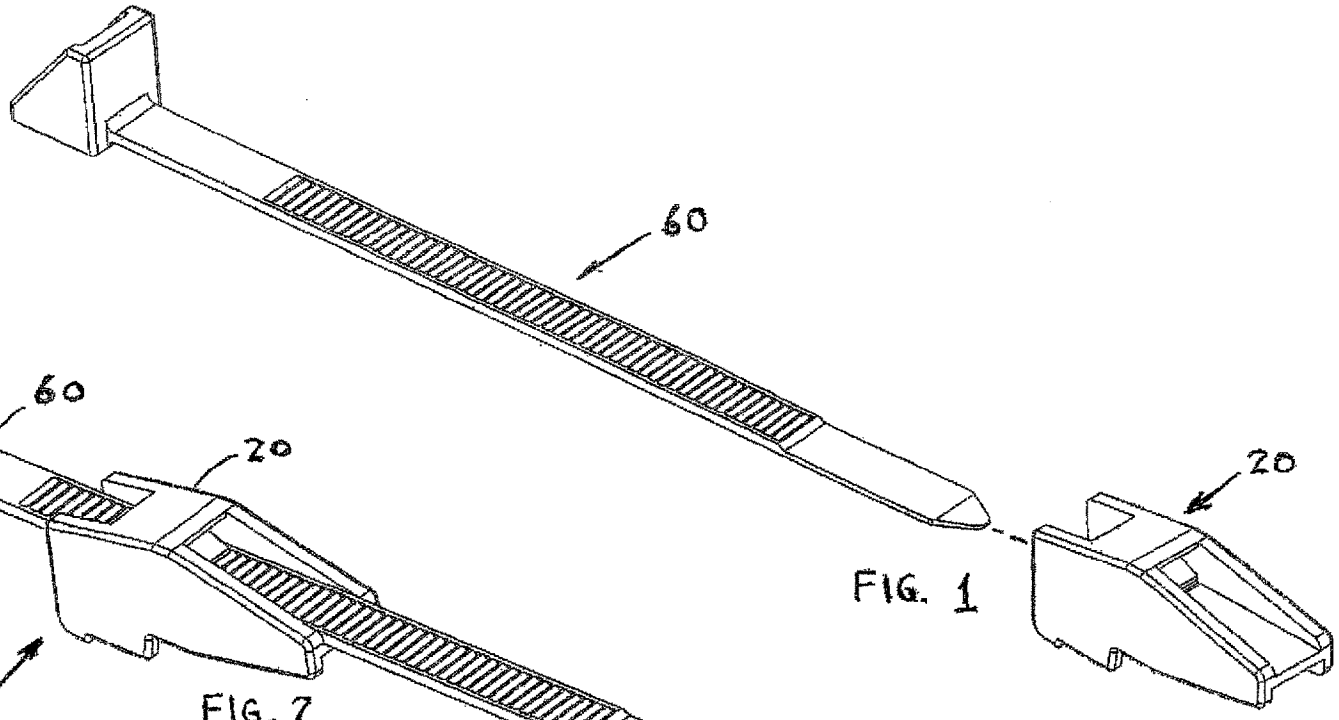
FIG. 1 is a perspective view of the strap and the pawl of the current invention aligned and ready for engagement.
Figure 2:
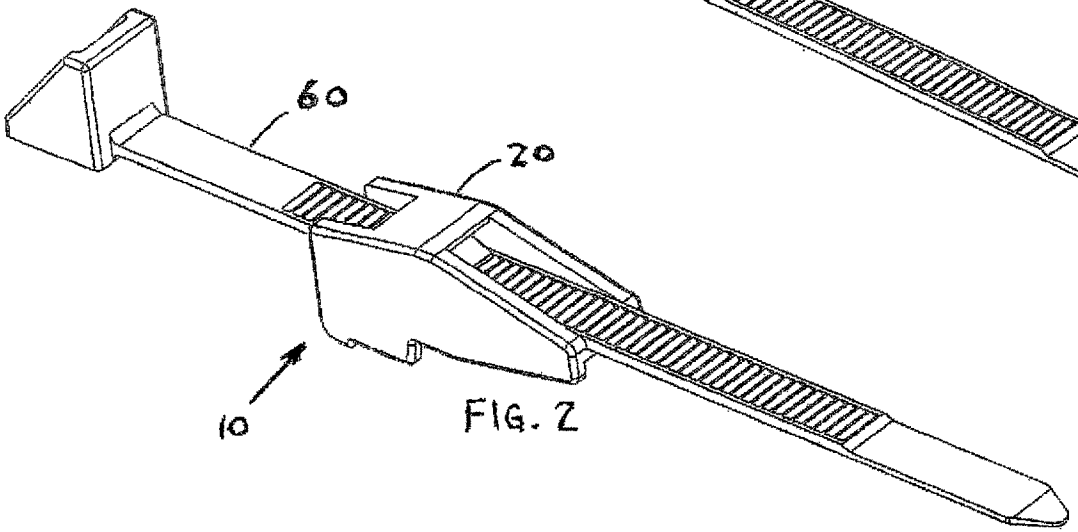
FIG. 2 is a perspective view showing the serrated strap engaged with the pawl of the current invention.
Figure 3:
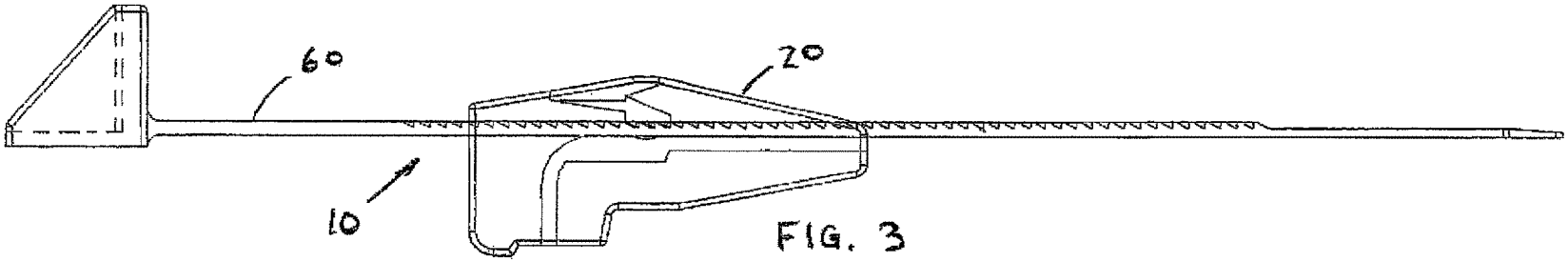
FIG. 3 is a side view showing the serrated strap engaged with the pawl of the current invention.
Figure 4:
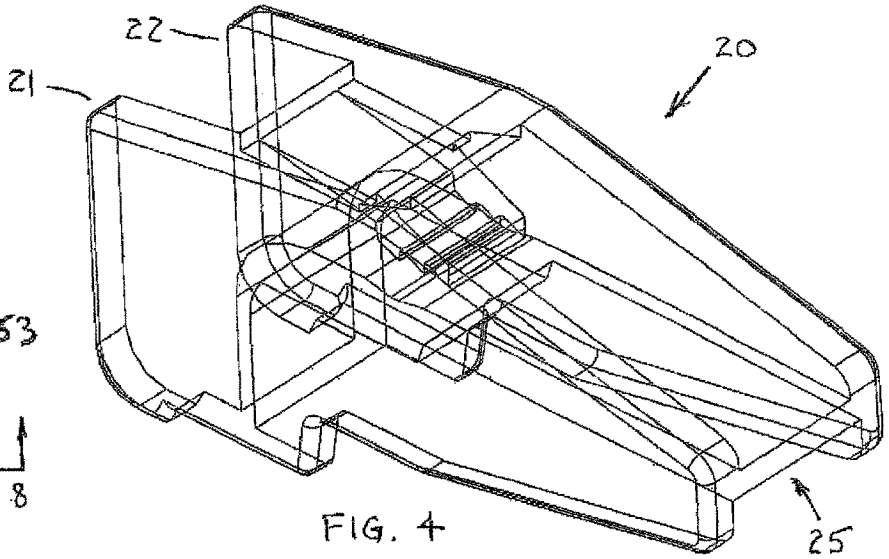
FIG. 4 is a wireframe perspective view of the pawl of the current invention.
Figure 7:
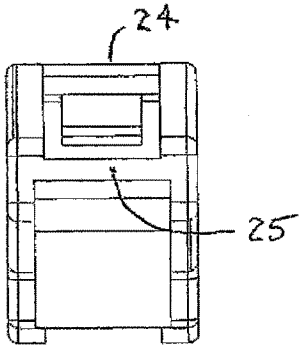
FIG. 7 is a side view of the pawl of the current invention.
Figure 6:
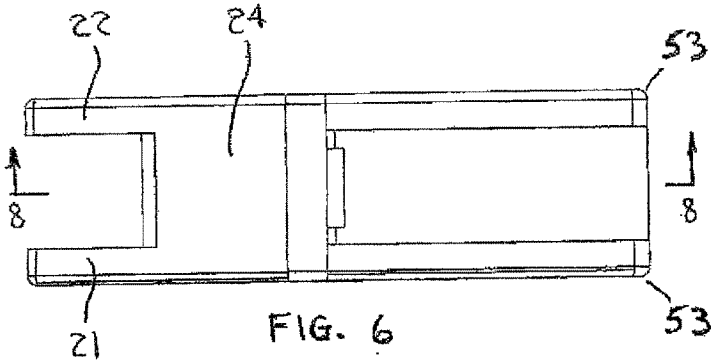
FIG. 6 is a top view of the pawl of the current invention.
Figure 5:
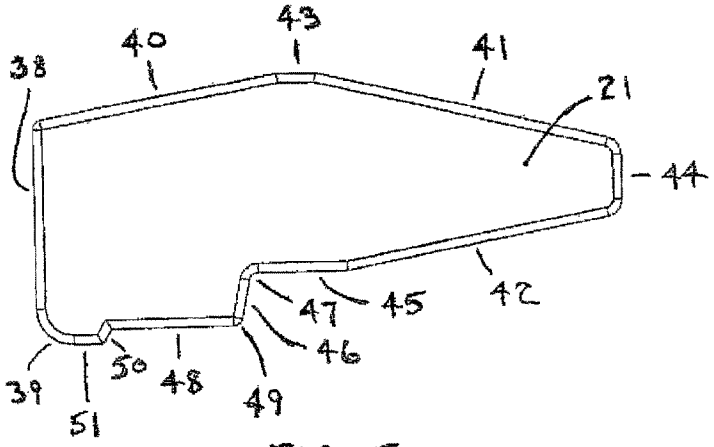
FIG. 5 is a front view of the pawl of the current invention.

FIG. 2 shows a first embodiment of the present invention, a transportation clip assembly 10, which includes a pawl member 20 and a strap member 60. FIG. 1 illustrates the strap member 60 as it is being inserted into the pawl member 20 to have engagement with, and mono-directional travel relative to, the pawl member. FIG. 3 shows a side view of the clip assembly 10.

The pawl member 20 and strap member 60 may be made from any suitable materials, including, but not limited to, plastic. In one embodiment the material may be an injection molded resin, such as nylon or polycarbonate. The pawl member 20 may be formed of various different shapes, and in one embodiment, shown in FIGS. 4-7, the pawl member 20 may have a first side wall 21 and a second side wall 22, which may be maintained at a set distance by top wall 24 and intermediate wall 25. First side wall 21 and second side wall 22 may be generally parallel to each other, but need not be so oriented.

The thickness of each of the walls may be adjusted to increase the overall strength of the clip assembly 10. The strength should accommodate most, if not all, sash windows, but could be increased with the aforementioned thickness changes to accommodate larger sliding doors. To encourage commonality, a single sized clip may be utilized for securing various fenestration products, and when it is necessary to secure larger, heavier sliding doors, multiple transportation clip assemblies 10 may be utilized rather than a single stronger clip.

The outer edges of the first side wall 21 and a second side wall 22 may have an outside corner radius 53 around the periphery of the walls to eliminate any sharp edges which might tend to scrape or otherwise damage the finish of the windows.

Figure 14B:
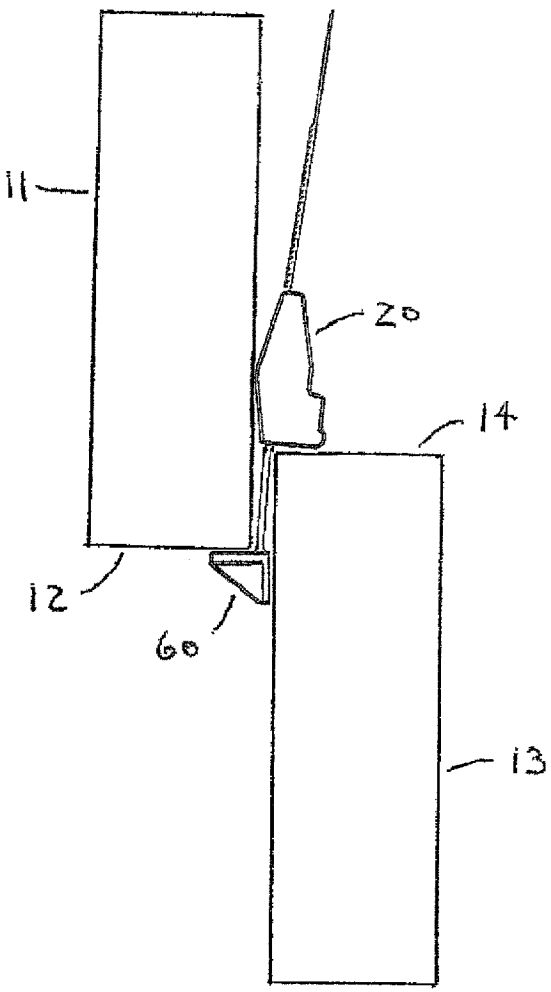
FIG. 14B is a side view showing a variation of the first installation embodiment of serrated strap engaged with the pawl of the current invention, as installed between the sashes of a sliding sash window, with the engagement wall of the bumper engaging the upper sash.
Figure 14A:
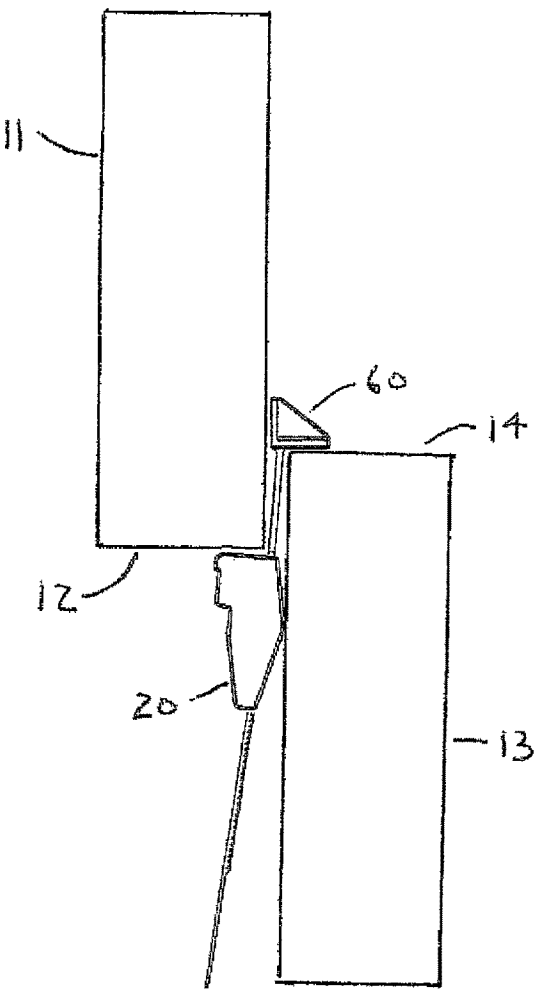
FIG. 14A is a side view showing a first installation embodiment of serrated strap engaged with the pawl of the current invention, as installed between the sashes of a sliding sash window, with the engagement wall of the bumper engaging the lower sash.

The periphery of the first and second side walls 21 and 22 may be formed with various different contours. As shown in one embodiment, side walls 21 and 22 may be formed with an engagement edge 38 that may transition into a rounded engagement corner 39 on one end, and into a lateral support edge 40 on the other end. These engagement features of the side walls 21 and 22 of pawl member 20 may bear up against the sashes of the window when engaged by the strap member 60, as seen in FIG. 14A and FIG. 14B.

The remaining outer edges of first and second side walls 21 and 22 may comprise various different configurations, and in one embodiment may have edges 41 and 42, whereby edges 40 and 41 may have a straight edge transition 43 between them, or a rounded corner (not shown), and edges 41 and 42 may have a straight edge transition 44 between them. Edge 42 may connect tangentially to the rounded engagement corner 39 (not shown), or alternatively, there may be edges 45 and 46, between which may be a radius 47, and there may also be an edge 48 that may be approximately parallel to edge 45. Edge 46 may transition into edge 48 using an outside corner 49. Edge 48 may transition into rounded engagement corner 39 by way of edges 50 and 51. The edges 42, 45, and 46 may serve as support for a tool that may be used to apply tension to the strap member 50 relative to the pawl member 20, and tightly secure both sashes 11 and 13 of the window relative to each other, and relative to the master frame 15 (FIG. 15A), as will be discussed hereinafter. In an alternate embodiment, discussed hereinafter, rounded engagement corner 39, and edges 50 and 51 may be seated between window sashes to secure the sashes.

Figure 8:
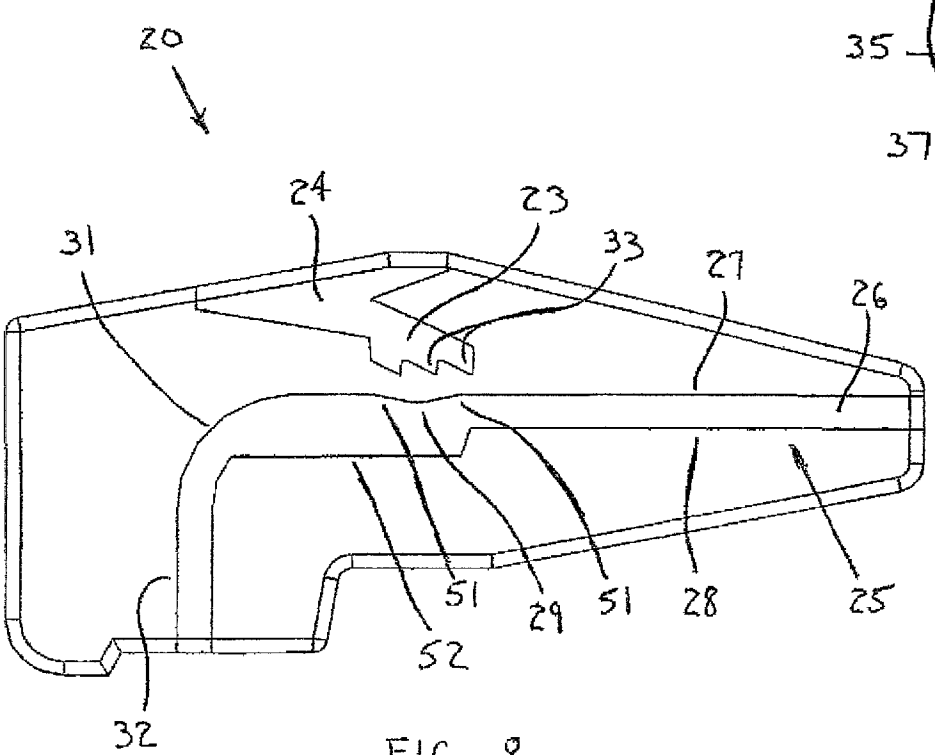
FIG. 8 is a section cut through the mid-plane of the pawl of the current invention.
Figure 17:
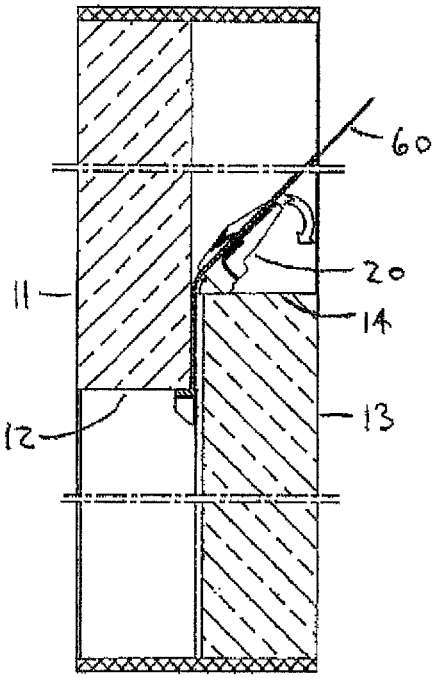
FIG. 17 is a side view showing the second installation embodiment with the serrated strap engaging the upper sash and engaged with the pawl of the current invention, as the pawl first contacts the lower sash of a sash window.
Figure 18:
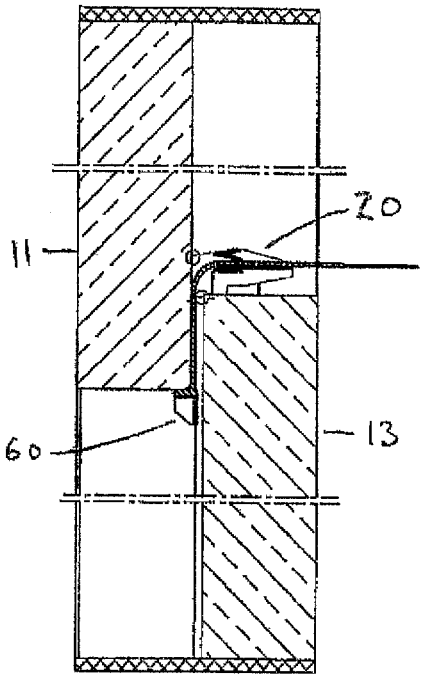
FIG. 18 is a side view showing the second installation embodiment with the serrated strap engaging the upper sash and engaged with the pawl of the current invention, as the pawl is snapped into place to secure the lower sash relative to the upper sash a window.
Figure 19:
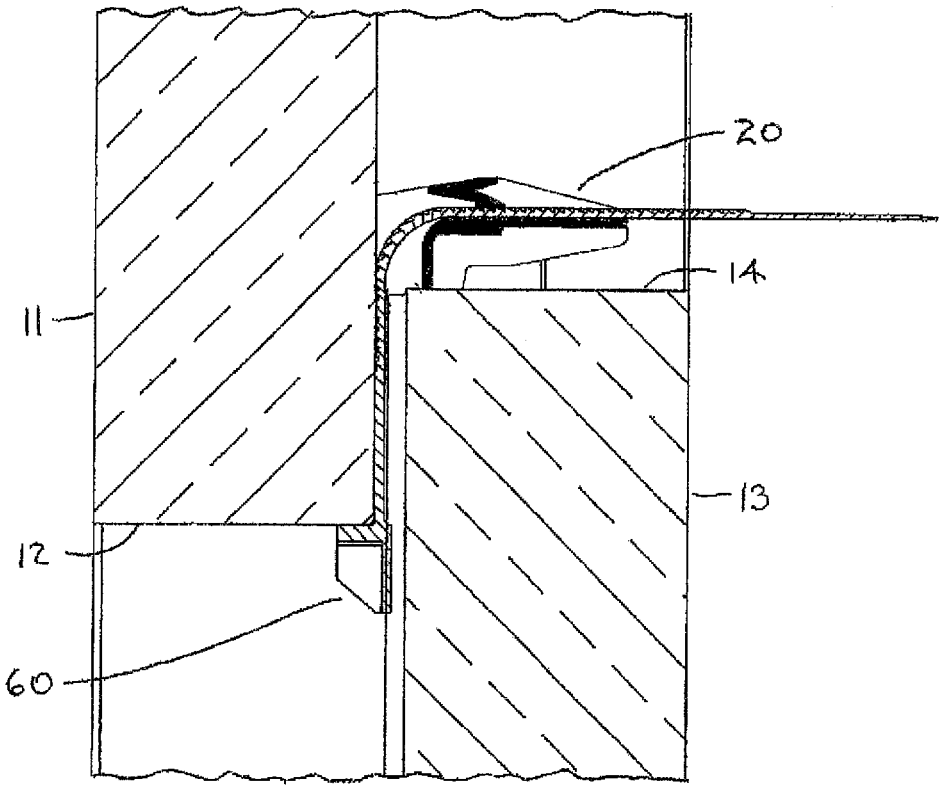
FIG. 19 is an enlarged side view showing the second installation embodiment with the serrated strap engaging the upper sash and engaged with the pawl of the current invention, as the pawl is snapped into place to secure the lower sash relative to the upper sash a the window.

The section view of FIG. 8, through pawl member 20, reveals the top wall 24 and intermediate wall 25. Intermediate wall 25 may be formed to have an axial portion, which as pictured in FIG. 8 appears as a horizontal wall portion 26 having a top surface 27 and a bottom surface 28. The horizontal wall portion 26 may transition, by way of a curved region 31, into a vertical wall portion 32. As may be seen hereinafter, the curved portion 31 may assist in guiding the strap member 60 to engage with the pawl member 20. The vertical portion 32 may serve to support the side walls 21 and 22, to deflect the strap member 60 when trying to engage it with the pawl member 20, or as structural support in an alternate embodiment (FIGS. 17-19).

The top wall 24 may span the entirety of edges 40, 41, and 43 of the first and second side walls 21 and 22, or may, as shown in FIG. 8, only span a portion thereof. Protruding inwardly from the top wall 24 and towards the top surface 27 of the horizontal portion 26 of intermediate wall 25, may be a triangular-shaped protrusion 23, which forms a gap 50 (FIG. 9) with top wall 24, making the protrusion 23 generally flexible with respect to top wall 24. The triangular-shaped protrusion 23 may have a plurality of teeth 33. Although only three teeth are shown in FIG. 8 for pawl member 20, the number of teeth may be increased to provide greater strength in the connection between the strap member 60 and pawl member 20, which may be required for corresponding increases in wall thicknesses, as previously described.

Figure 9:
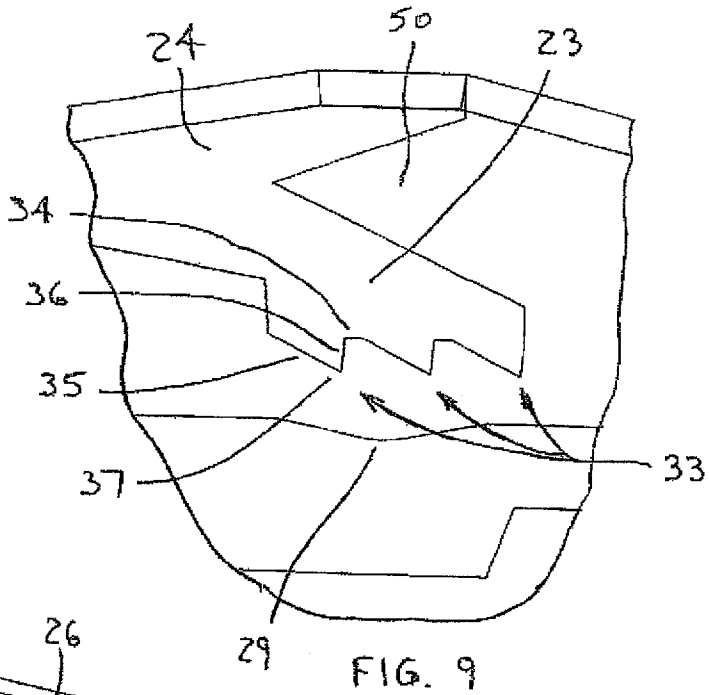
FIG. 9 is an enlarged view of the pawl teeth of the current invention.

As seen in the enlarged view of the plurality of teeth 33 in FIG. 9, each tooth may be formed to have a back face 35, which meets a front face or engagement surface 36 at the apex 37. Where the back face of one tooth meets the front face of an adjacent tooth may be a trough 34. The back face 35 and front face 36 are shown in to be flat in FIG. 9, with the front face being approximately perpendicular to the intermediate wall 25; however, other possible shapes and orientations may be utilized. The configuration shown may be preferable to assist in the mating of the strap member 20 with the pawl member 60. The distance between the apex 37 of the plurality of teeth 33 and the top surface 27 of the horizontal portion 26 of intermediate wall 25 may be crucial to the interconnection between the strap member 60 and pawl member 20, which is discussed further hereinafter.

The strap member 60 may be formed to have a bumper portion 80 connected to a strap portion 61. Bumper portion 80 may be formed a number of different ways. In one embodiment, bumper portion 80 may be comprised of only an engagement wall 81. However, to help counter unintended rotation of the engagement wall 81 upon installation of the strap member 60 between first and second sashes 11 and 13 of a window, engagement wall 81 may preferably be connected to a bottom wall 84. Bottom wall 84 may preferably be approximately orthogonal to engagement wall 81. This orthogonal relationship between bottom wall 84 and engagement wall 81 may be supported by first and second side walls 82 and 83, which may be parallel to each other.

All of the exterior edges of the bottom wall 84, engagement wall 81, and first and second side walls 82 and 83 may be rounded through use of outside corner radius 85. Having the corners thus relieved may serve to prevent scrapes and other facial damages to the windows upon which the transportation clip assembly 10 may be installed. In addition, the engagement wall 81 may have a cushioning material (not shown) attached thereto to further protect the window. The cushioning material may include, but is not limited to, rubber that is attached to the engagement wall 81 through any acceptable means for the particular cushioning material chosen, including, but not limited to, glue or epoxy. The same cushioning material may also be utilized upon the engagement edges 38 of the first and second side walls 21 and 22 of the pawl member 20.

The strap portion 61 of strap member 60 may be comprised of a plain strap 62, which may be connected to the engagement wall 81 of the bumper portion 80 using fillet radii 63, which may thereby improve the durability of the connection. Plain strap 62, may, but need not, have a rectangular cross-section, having a thickness 71. The plain strap 62 may transition into a serrated strap 64, which may have the same cross-section as plain strap 62, but which further comprises a plurality of strap teeth 66, which may be similarly constructed as the plurality of pawl teeth 33, but formed so as to be complementary in nature to the pawl teeth 33 so as to mesh with and thereby be retained by the pawl teeth 33 of pawl member 20 when the strap member 60 is therein inserted.

The plurality of strap teeth 66 may be formed within the thickness 71 of the cross-section of the serrated strap 64, leaving a narrow portion of plain strap 64 on each side of the strap teeth 66, which may not extend to the full width of the serrated strap 64.

Proper functional engagement of the plurality of strap teeth 66 with the plurality of pawl teeth 33 is obtained through careful control of several features and dimensions. As previously stated, the distance between the apexes 37 of the plurality of teeth 33 of pawl 20 from the top surface 27 of the horizontal portion 26 of intermediate wall 25 may be crucial to this functional engagement. Proper engagement may generally depend upon trapping the serrated strap 64 against the top surface 27 of the horizontal portion 26 of intermediate wall 25. Snugly trapping the serrated strap 64 may preferably require a combination of deflection of the protrusion 23 and deflection of the serrated strap 64 when feeding the strap member 60 into pawl member 20.

Deflection of the protrusion 23 may occur when the strap teeth 66 contact the pawl teeth 33 resulting in an applied load to the protrusion and causing angular deflection at the gap 50 (FIG. 9) towards the top wall 24. This invention furthermore takes advantage of the flexural nature of the strap portion 61 when being inserted into the pawl member 20, through its tendency to bend or even buckle under compression loading, by incorporating a recess 29 in the top surface 27 of the horizontal portion 26 of the intermediate wall 25. The recess 29 may necessitate the use of a step 52 in the lower surface 28 of the horizontal portion 26 of intermediate wall 25 to increase thickness, in order to accommodate the thickness reduction due to the recess 29.

The recess 29 allows the serrated strap 64 region of strap 60 to deflect downward, under the compression loading, away from the plurality of teeth 33 of the triangular protrusion 23, as the triangular protrusion 23 and teeth 33 simultaneously deflect upward. The recess 29 may have curved transitions 51 with the top surface 27 of the intermediate wall 25 to facilitate bending of the strap 60 in proximity to the plurality of teeth 33 of the pawl 20. The recess 29 may preferably have a maximum depth such the distance between the apex of the teeth 33 of the pawl 20 and the recess 29 is approximately equal to the thickness 71 of the strap.

It may be seen that loading of the strap 60 in tension relative to the pawl 20, by sash windows 11 and 13 (FIG. 14A), may cause the protrusion 23 with the plurality of teeth 33 to deflect downward and trap the strap 60 against the top surface 27 of the horizontal portion 26 of intermediate wall 25. The downward deflection of protrusion 23 with the plurality of teeth 33 would not permit the recess 29 to facilitate disengagement of the serrated strap 64 from the pawl 20, the way the recess 29 facilitates engagement.

Initial engagement of the strap 60 with the pawl 20 may be furthered by having a plain strap section 67 which may be thinner than plain strap 62, and may transition to the serrated strap 64 using a ramp 68. The thin plain strap 67 may terminate in a tapered and ramped end 69. The tapered/ramped end 69 may have an orifice 70 which may be used in conjunction with a tool to apply tension to the strap 60 relative to the pawl 20, to pre-load the window sashes 11 and 13 relative to each other, and in a direction opposite to each other, when in the closed position. In general, the upper sash 11 will be loaded towards the upper portion of the master frame 15, with a corresponding loading of the lower sash 13 towards the lower portion of the master frame. The tool may have a prong that retains the orifice 70 and allows the strap portion 61 to be rolled up on the tool, and whereby the roll may act against the edges 45 and 46 of first and second side walls 21 and 22 of pawl 20. The ability to apply such tension between the pawl member 20 and the strap member 60 permits further engagement of one or more of the pawl teeth 33 with said strap teeth 66 to generate the pre-loaded sash arrangement. The pre-loaded window sashes 11 and 13 will be biased away from each other, and be biased to engage the master window frame (not shown), without having to use the locking hardware of the window.

FIG. 14A illustrates the strap member 60 after having been engaged with the pawl member 20 to restrict relative movement of the upper sash 11 and lower sash 12 of a sliding sash window. As seen in FIG. 14A, the strap portion 61 of the strap 60 may be inserted through a space between a meeting rail 14 of a first sash 13 and a meeting rail 12 of a second sash 11. The engagement wall 81 of the pawl 20 may abut the meeting rail 14 of said bottom sash 13. The free end 69 of the strap portion 61 may be inserted into the gap in the pawl member 20 between the strap teeth 33 and intermediate wall 25, such that the strap teeth 33 of the serrated strap 64 engage the pawl teeth 66.

The strap portion 61 may thus be continuously inserted until the engagement edge 38 of the first and second side walls 21 and 22 of the pawl member 20 contacts the bottom rail 12 of the sash 11. The rounded engagement corner 39 may also contact the bottom rail 12, as the installation of transportation clip assembly 10 may tend to cause slight rotation of the pawl member 20. In addition, the lateral support edge 40 and transition edge 43 may contact the lower sash 13, with such rotation. The existence of, or the amount of, rotation may depend upon the extent of pre-loading that is established.

Figure 15C:
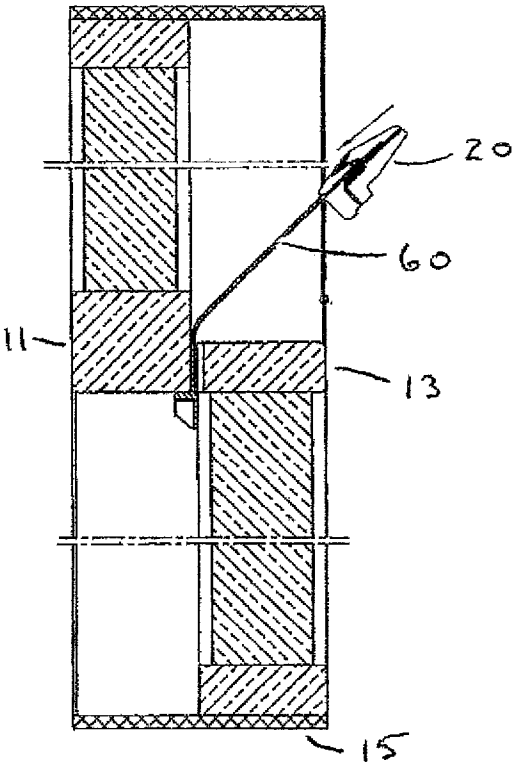
FIG. 15C is a side view showing a second installation embodiment of the serrated strap engaged with the pawl of the current invention, as installed between the sashes of a sliding sash window.
Figure 15B:
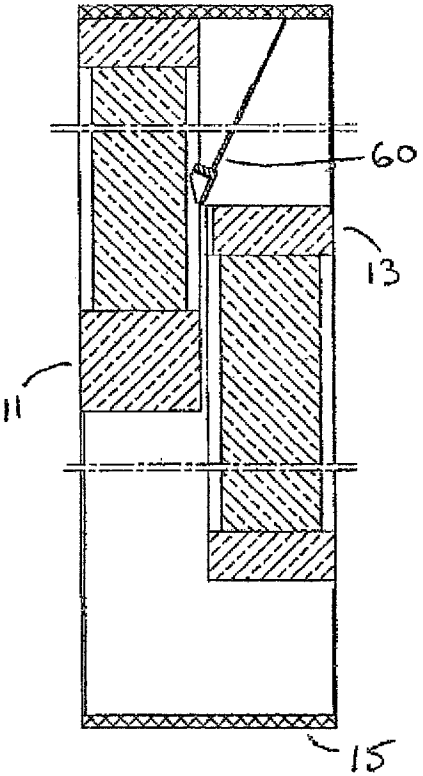
FIG. 15B is a side view showing the first step in a second installation embodiment of the serrated strap being engaged between the sashes of a sliding sash window.
Figure 15A:
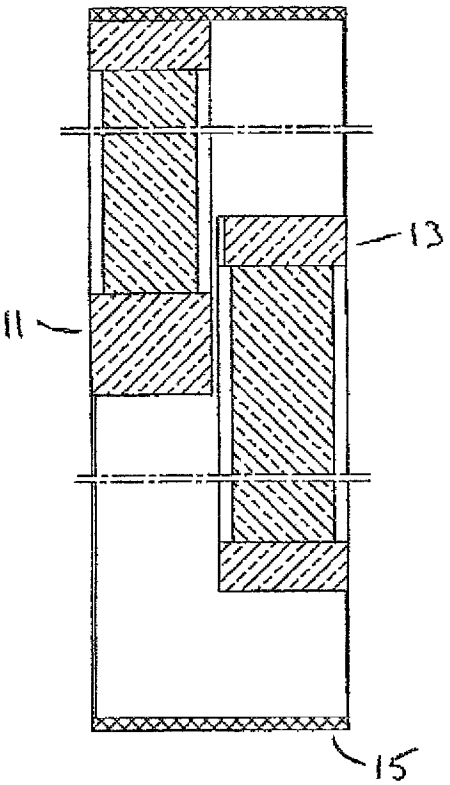
FIG. 15A is a side view of a sliding sash window in a master frame, with one sash opened.
Figure 16B:
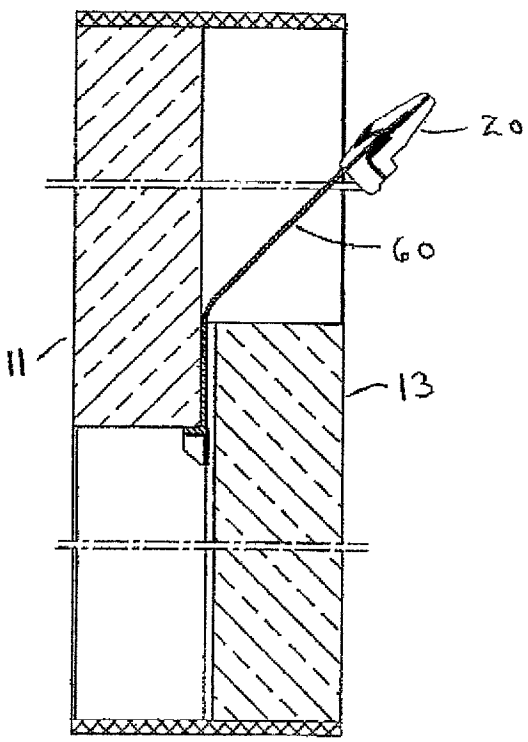
FIG. 16B is a side view showing an installation embodiment of the serrated strap engaged with the pawl of the current invention, as installed between the sashes of a tiltable sash window.
Figure 16A:
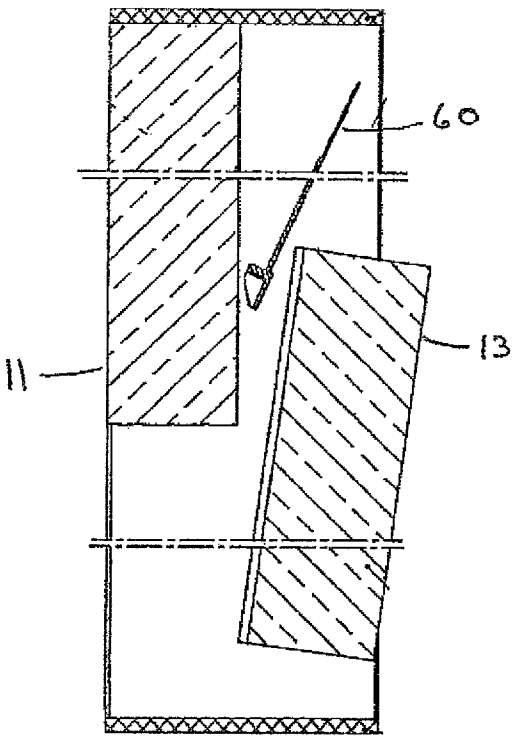
FIG. 16A is a side view showing the first step in an installation embodiment with the serrated strap being fed between the sashes of a tiltable sash window.

An alternate installation embodiment is shown in FIGS. 15A through 15C for a sliding sash window, and in FIGS. 16A and 16B for a tiltable/slidable sash window. For both window types, the bumper portion 80 of the strap member 60 may be fed between the two sashes, while the sash is slid open or tilted open. The engagement wall 87 of the bumper portion 80 of the strap member 60 may then rest up against the bottom rail 12 of the upper sash 11. The pawl member 20 may be inserted upon the strap member 60, as seen in FIG. 17, until the rounded engagement corner 39 contacts the top rail 14 of lower sash 13. The pawl member 20 may then be rotated so that engagement wall 87 of pawl member 20 butts against the side of the bottom rail 12 of upper sash 11, while edge 48 of pawl member 20 butts against the top of bottom rail 14 of lower sash 13. Thereafter, rounded engagement corner 39 and edge 51 may be snapped into the gap between the sashes 11 and 13 (FIGS. 18-19).

Figure 20:
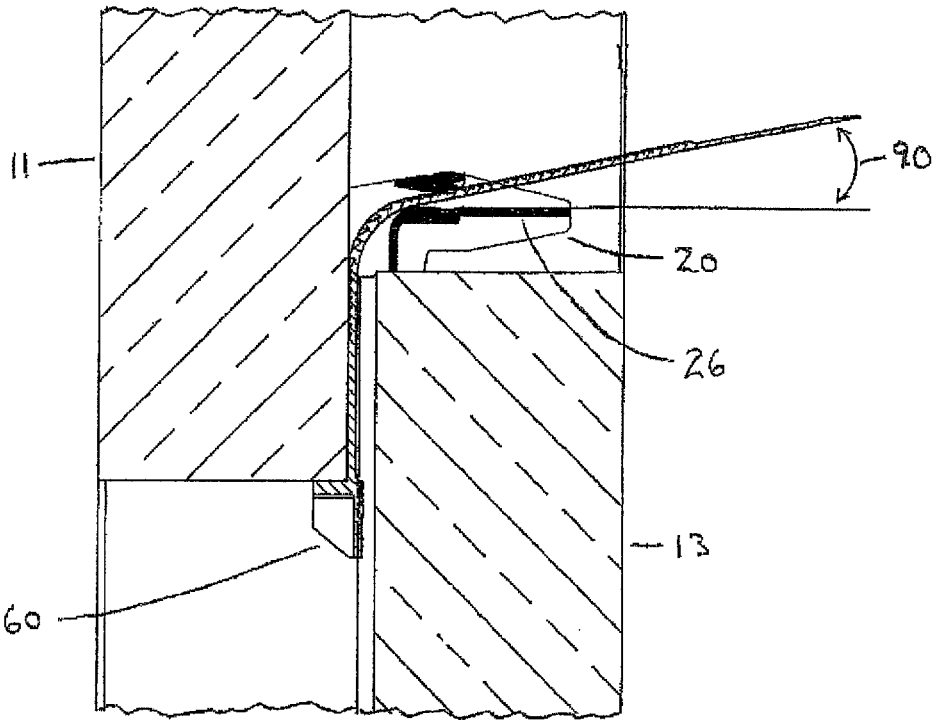
FIG. 20 is an enlarged side view showing disengagement of the serrated strap from the pawl of the current invention, through failure of the pawl teeth and the pawl top wall.

Removal of transportation clip assembly 10 is illustrated in FIG. 20. Removal is accomplished by applying a force to the thin plain strap 67 of strap member 60, such that it is at an angle 90 relative to portion 26 of intermediate wall 25 of pawl 20. Application of such a force causes failure of the pawl teeth 33 and of top wall 24, with release of the strap member 60 from pawl member 20.

Figure 23:
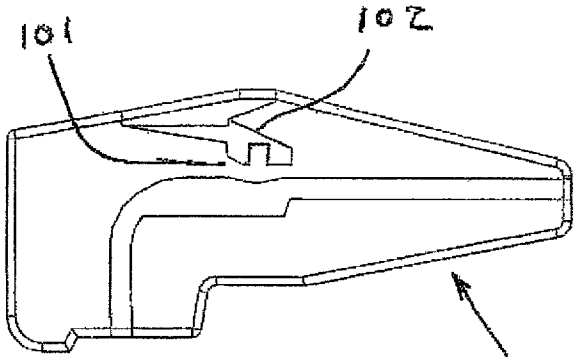
FIG. 23 is a side view of an alternate pawl configuration with a protrusion orifice.
Figure 21:
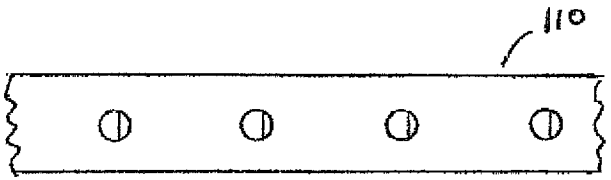
FIG. 21 is a top view of an alternate strap configuration with cylindrical protrusions.
Figure 22:
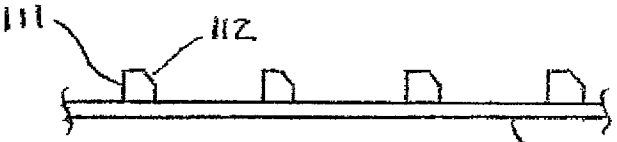
FIG. 22 is a side view of the alternate strap configuration of FIG. 21.
Figure 24:
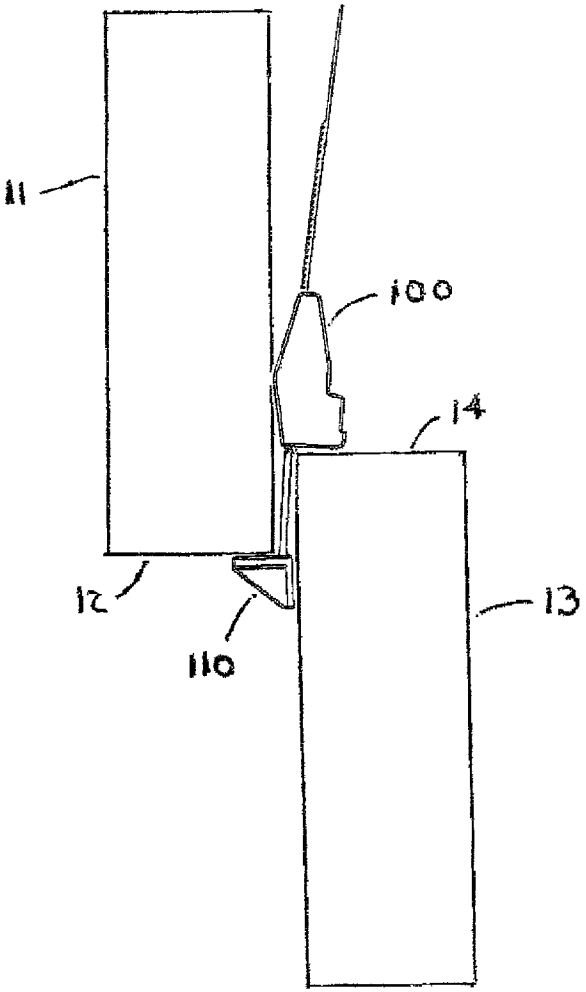
FIG. 24 is a side view showing installation of the alternate strap securing the upper sash and engaged with the alternate pawl configuration, which secures the lower sash.

An alternate embodiment of the current invention is shown in FIGS. 22 through 24. FIGS. 21 and 22 illustrate an alternate embodiment in which strap member 100 has, instead of strap teeth, a plurality of cylindrical protrusions 101, each of which has a slanted face 112 oriented so as to face away from the bumper portion. The slanted face 112 may engage the protrusion 101 of pawl member 100 to permit deflection of the protrusion 101, as well as flexing of the strap 110, with incremental engagement of cylindrical protrusions 111 of strap 100 with orifice 102 of the protrusion 101.

Figure 25:
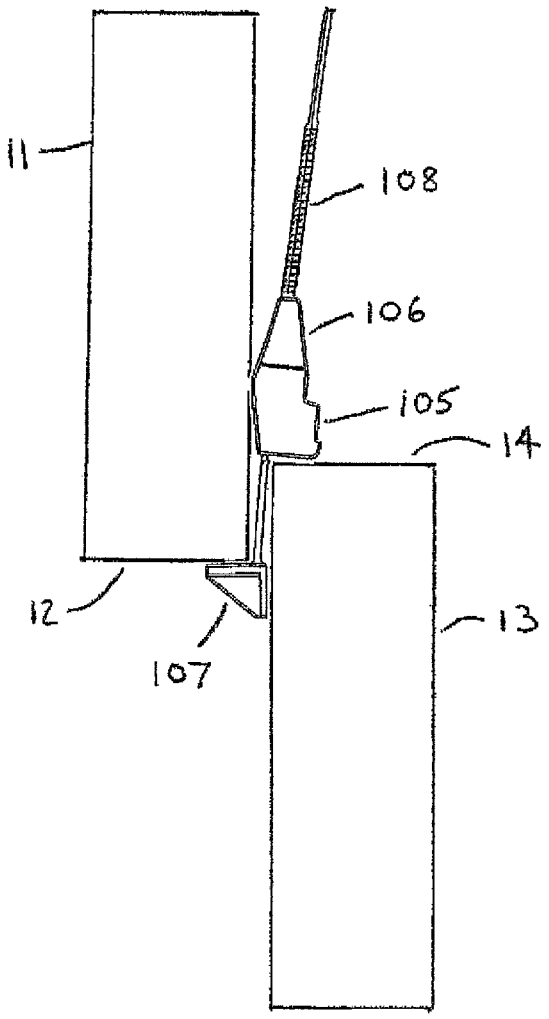
FIG. 25 is a side view showing installation of the threaded strap configuration securing the upper sash and engaged with the threaded pawl configuration, which secures the lower sash.

In another alternate embodiment, shown in FIG. 25, the strap 107 transitions from a thin flat strap portion into an externally threaded cylindrical portion 108 that is received by internal threading on the pawl 105. The pawl 105 may have a swivel end 106 to permit rotational engagement of the threaded portion 108 of the strap 107 without rotation of the pawl 105 at the rail 14 of window 13.

Figure 26:
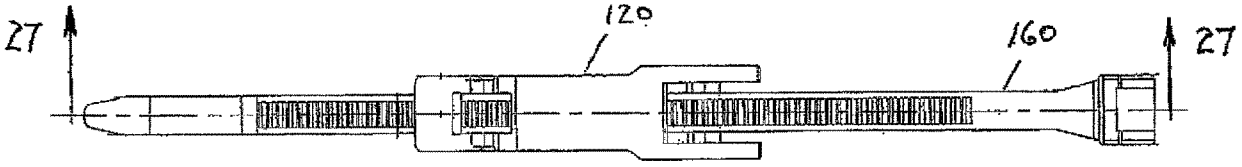
FIG. 26 is a side view showing an alternate embodiment for the pawl, as engaged with the serrated strap of the current invention.
Figure 27:
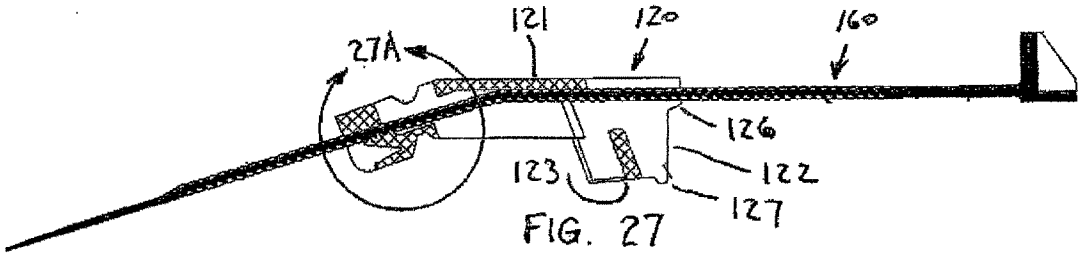
FIG. 27 is a section view through the alternate embodiment of the pawl of FIG. 26, as engaged with the serrated strap of the current invention.

In FIGS. 26 and 27, an alternate embodiment is shown with a pawl 120, which may be utilized for two different installation configurations. The pawl 120 may resemble pawl 20 with its engagement edge 38, rounded engagement corner 39, edge 48, and lateral support edge 40, but pawl 120 may instead have an engagement edge 122 connected to edges 121 and 123. A rounded engagement protrusion 127 may be located where engagement edge 122 connects to edge 123, and a second protrusion 126 may be located where edge 122 connects to edge 121.

Figure 28:
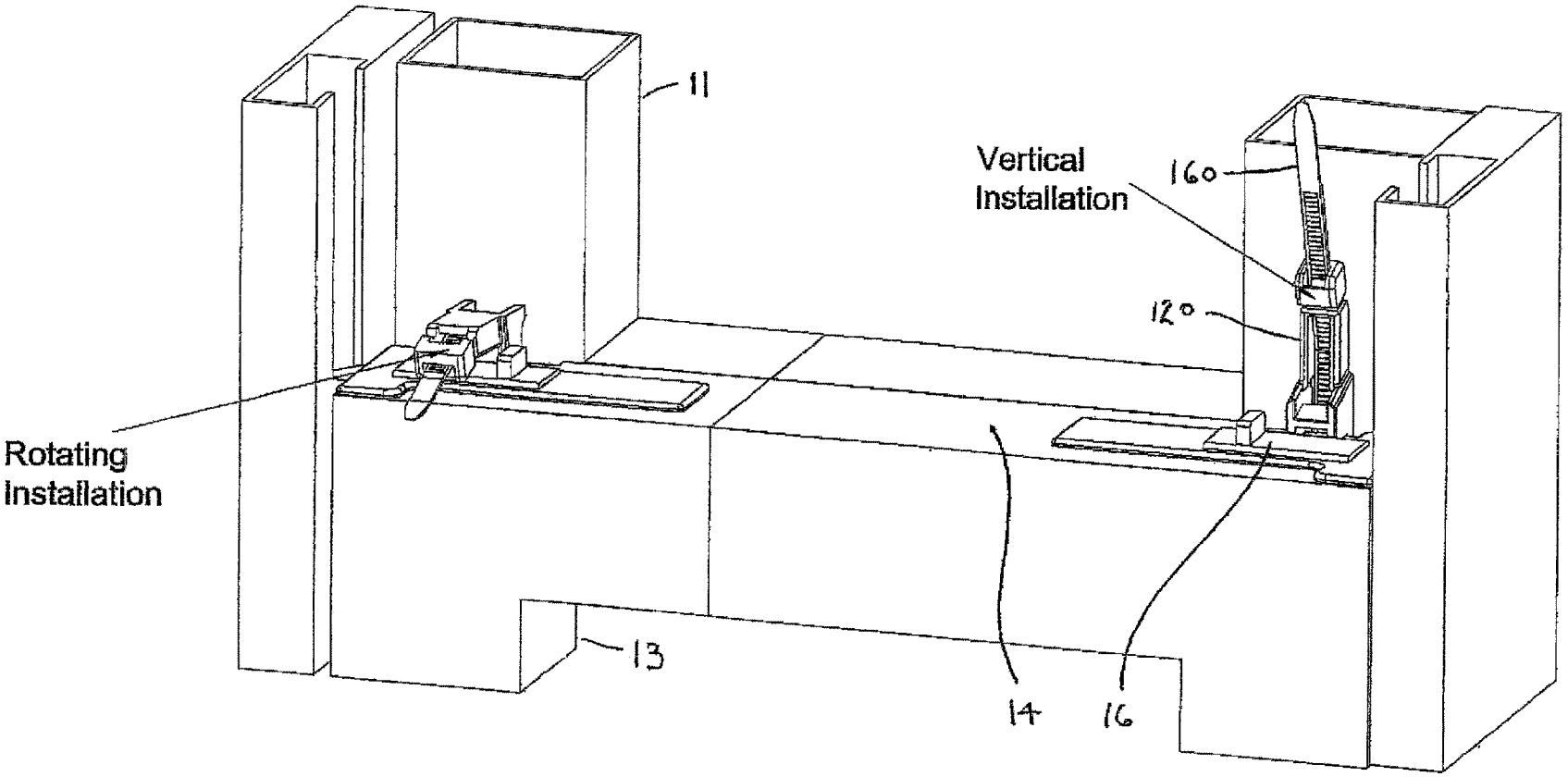
FIG. 28 is a perspective view showing alternate installations with a sash window for the alternate embodiment of the pawl of FIG. 26, as engaged with the serrated strap of the current invention.

The protrusions 126 and 127 being thus arranged may accommodate two different installation configurations. As seen on the right side of FIG. 28, the pawl 120 may engage the alternative embodiment strap 160 and be tensed therebetween such that the edge 122 of pawl 120 engages the top rail 14 of window sash 13, without contacting latch 16. The protrusion 126 may thereby be engaged in the gap between the top rail 14 of the lower sash 13, and the bottom rail of the upper sash 11, to assist in securing the clip assembly to the window sashes. Alternatively, as seen on the left side of FIG. 28, the pawl 120 may engage the strap 160 with edge 122 coming in close proximity to top rail 14 of lower sash 13, but not necessarily making contact therebetween, as the pawl 120 may then be rotated, as was illustrated in FIGS. 17 and 18. The rotation may serve to provide additional loading of the sashes relative to the master frame, with the loading of one sash being in a direction opposite to the loading of the second sash.

The rotation of pawl 120 permits the edge 123 of pawl 120 to engage the top rail 14 of window sash 13, without necessarily contacting latch 16, and with second protrusion 127 to be engaged in the gap between the top rail 14 of the lower sash 13 and the bottom rail of the upper sash 11 in a horizontal position. This engagement of the second protrusion 127 may serve to prevent counter-rotation of the pawl 120, which would reduce the preloading of the sashes relative to the master frame. The rotation required for the horizontal installation may serve to provide a greater tension force between the window sashes 11 and 13, which may be needed for transportation of larger and heavier doors and windows.

Figure 27A:
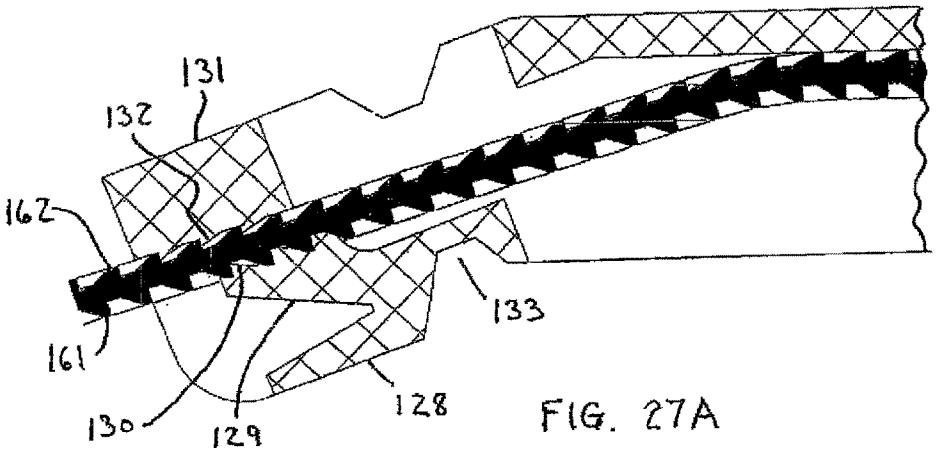
FIG. 27A is an enlarged view showing engagement of the pawl teeth with the strap of the alternate embodiment of FIG. 27.

Pawl 120 may also comprise, as seen in FIG. 27A, a wall 128 with protruding portion 129 having a plurality of teeth 130, as well as a wall 131, which are comparable to the top wall 24, protruding portion 23 and intermediate wall 25 of pawl 20. However, in pawl 120, wall 131 also may have a plurality of teeth 132. Also, the strap member 160 may have a serrated strap portion with a plurality of teeth 161 on one side of the strap 160 to engage the teeth 130 on protruding portion 129, as well as a plurality of teeth 162 on the opposite side to engage the teeth 132 of wall 131. Therefore, the engagement of strap 160 with pawl 120 may occur with engagement of teeth on both sides of the strap 160 to provide a sturdier connection therebetween, which may be beneficial for the horizontal installation where greater loads may be involved. The teeth 161 need not be aligned with teeth 162, and may instead be staggered as seen in FIG. 27A.

The pawl 120 may also have walls 128 and 131 oriented at an angle from wall 121, with a narrow, necked down region 133 located at the intersection of those walls. The neck down region 133 may be utilized to cause failure of the engagement between strap 160 and pawl 120 by applying a force directly to the pawl 120, once the sash window or door is ready for installation in a building, and the installer seeks to remove the clip. Alternatively, failure may also be caused by applying a load only to the strap 160, as was previously discussed.

Figure 29A:
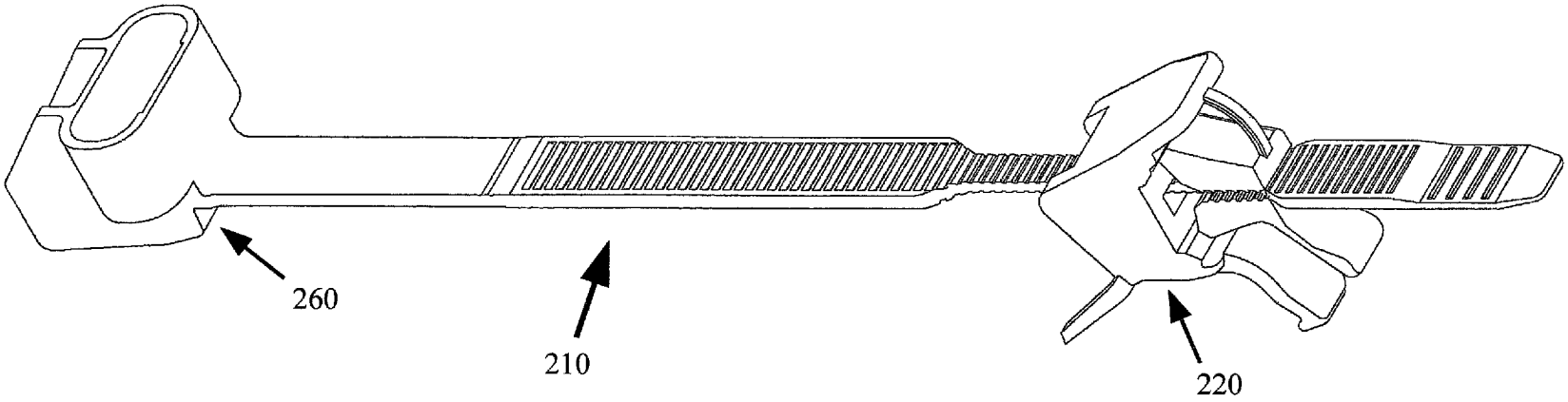
FIG. 29A is a top perspective view of an alternate embodiment of the strap and pawl of the current invention.
Figure 29B:
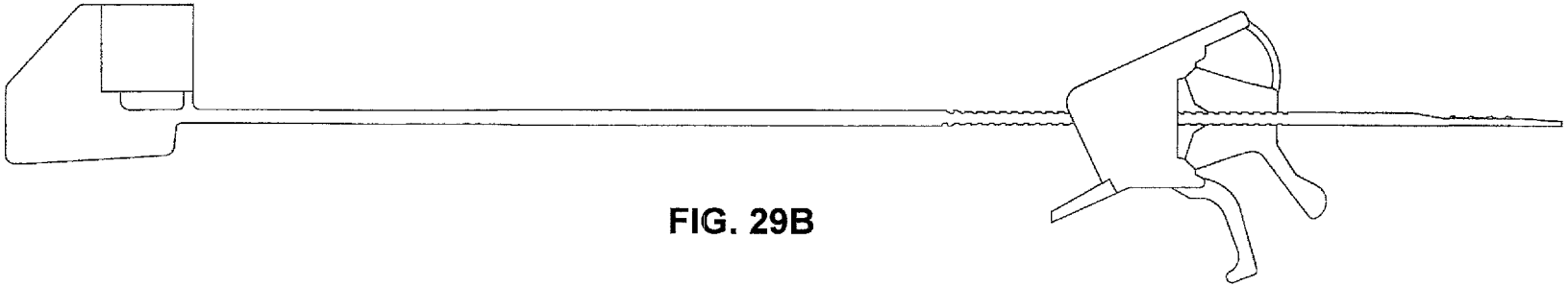
FIG. 29B is a side view of the strap and pawl of FIG. 29A.

Another alternate embodiment of the present invention is seen in the perspective view of the engaged pawl/strap combination 210 in FIGS. 29A and 29B, which may include strap member 260 and pawl 220. The strap member 260, which may include the bumper portion 260B and the strap portion 260S, is shown separately in the views of FIGS. 30-34, and the pawl 220 is shown separately in the views of FIG. 35-37.

Figure 10:
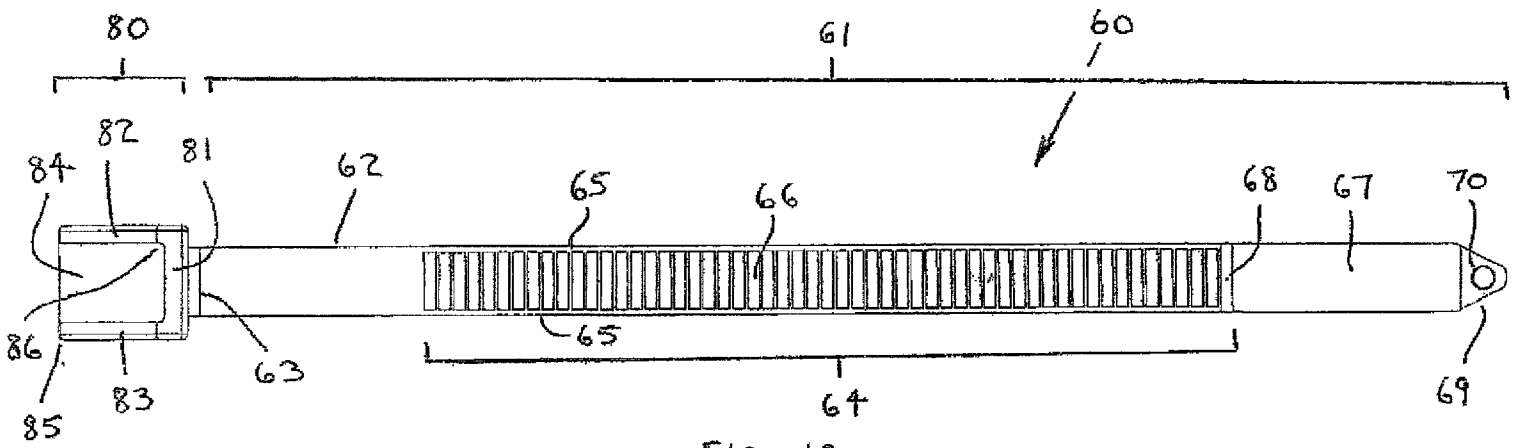
FIG. 10 is a top view of the strap of the current invention.
Figure 11:
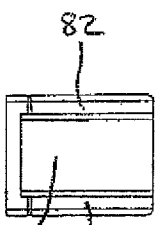
FIG. 11 is an end view of the strap of the current invention.
Figure 12:
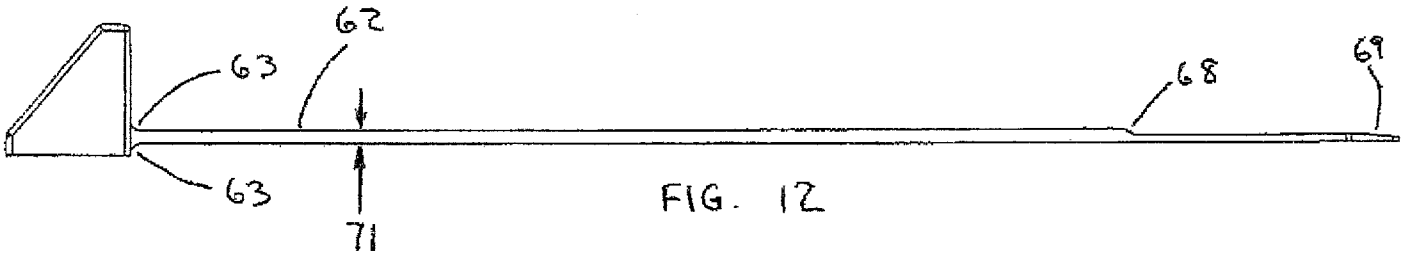
FIG. 12 is a side view of the strap of the current invention.
Figure 13:
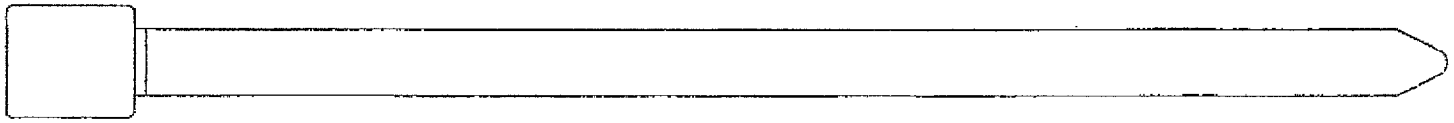
FIG. 13 is a bottom view of the strap of the current invention.

The strap member 260 is specially configured to provide additional benefits in seeking to pre-load the two sash members with respect to each other, and with respect to the master frame in which they travel. The engagement wall 281 of the bumper portion 260B of strap member 260, rather than being directly and rigidly supported by the stiffeners that are used for wall 81 of strap 60 (FIG. 10), may instead be supported by an arrangement that is configured to be more conducive to accommodating a certain amount of elastic deformation, to enable a more adjustable and calibrated amount of preloading of the sashes.

A portion of the engagement wall 281 of the bumper portion 260B of strap member 260 (FIG. 30) may transition into an enclosed geometric shape 281G. Many different cross-sections may be utilized to create the enclosed geometric shape, including ones with curvature, such as a circular ("O") cross-sectional shape; an oval cross-sectional shape; an elliptical shape; a race track shape, an hourglass shape, an irregularly curved shape, etc. Alternatively, a polygonal cross-sectional shape may be used (e.g., octagonal). In addition, the cross-sectional shape need not be extruded orthogonally to form the enclosed geometric shape, and also could be decreasing in scale as it is extruded, as with, for example, a circular cross-sectional shape being used to produce a hollow conical member (or hollow conical frustum) for the enclosed shape, rather than a hollow cylinder.

Figure 30:
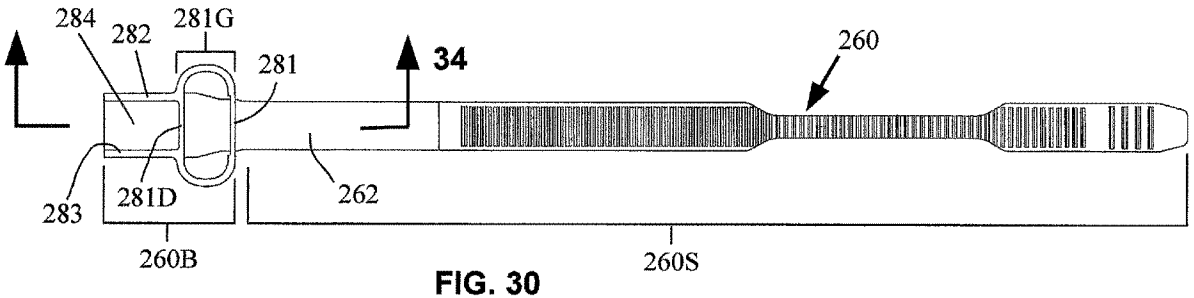
FIG. 30 is a top view of the strap of FIG. 29A.
Figure 31:
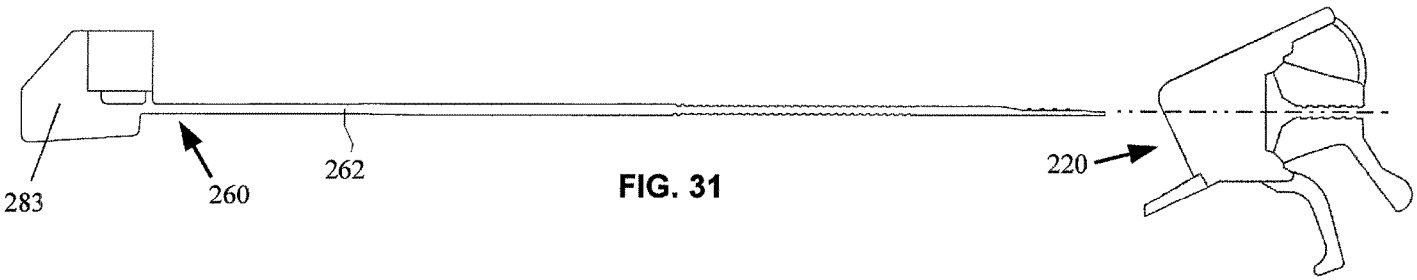
FIG. 31 is a side view of the strap and pawl of FIG. 29A, prior to engagement therebetween.
Figure 33:
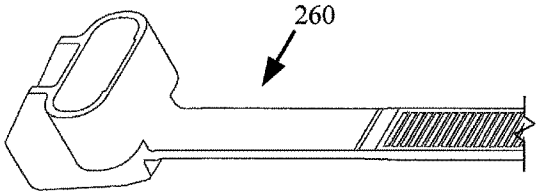
FIG. 33 is a first perspective view of the strap of FIG. 29A.
Figure 34:
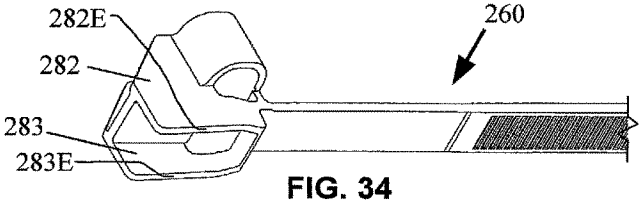
FIG. 34 is a second perspective view of the strap of FIG. 29A.

The enclosed geometric shape 281G may be supported at a portion of it that is distal from the "engagement wall" 281, by one or more stiffeners. It should be noted that the cross-section used for the enclosed geometric shape 281G of the strap member 260 in FIG. 30 is a race track shape, and it may be seen therein to produce a discrete "engagement wall" portion 281 that may generally be flat. This generally flat engagement wall portion 281 may initially be that part of the bumper that contacts and "engages" the sash, when the clip assembly 210 is installed upon a sash window or door. If the cross-sectional shape utilized for the bumper were instead a circular shape that produced a hollow cylinder, the contact with the sash by that enclosed geometric shape would initially be at only a very narrow portion of the cylinder that may not necessarily be visualized as a "wall" in the typical sense (i.e., not being rectangular), however, that initial point of contact by the enclosed geometric shape (cylindrical or otherwise) with the sash is nonetheless herein referred to as the "engagement wall" or "engagement wall portion," and is intended to convey to the reader, that portion of the enclosed geometric shape that initially makes contact with the sash.

The enclosed geometric shape 281G of the bumper portion 260B of the strap 260 that is formed using a racetrack cross-section, as illustrated throughout the figures herein merely to be exemplary, may be supported by only a single stiffener that may be centrally positioned thereon. However, with the use of a race track shape, a single central stiffener may tend to produce less resistance to the deformation that is caused by the preloading of the sash window/door (i.e., produces a "soft" support that may be better used for smaller light-weight sash members). The single stiffener may also be more suitable for where a circular cross-section was used to produce the enclosed geometric shape.

Figure 32:
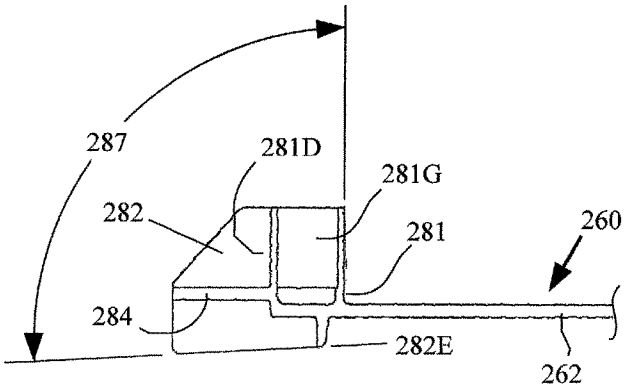
FIG. 32 is a cross-sectional view through the bumper portion of the strap of FIG. 29A.

As seen in FIG. 30, a first stiffener 282 and a second stiffener 283 may be used to support the racetrack-shaped bumper, and each may extend orthogonally from the flat wall portion 2811) that is opposite or distal from the engagement wall portion 281, and the stiffeners may also be positioned so as to extend from that part of the wall portion 281D being proximate to the tangency with the curved end portions of the racetrack shape. The stiffeners 282 and 283 may also be interconnected by a lateral stiffener 284, which may be offset from the strap portion 262 (FIG. 32). In addition, each of the stiffeners 282 and 283 may extend to have a respective portion be fixedly secured to the strap portion 262 (see FIG. 31). The walls 282 and 283, which may be perpendicular to the strap portion 262, may also extend beyond the strap and terminate in respective engagement surfaces 282E/283E (see FIG. 34). The engagement surfaces 282E/283E of stiffeners 282 and 283 may generally be angled with respect to the strap portion 262, and may thus be at angle 287 to the engagement wall 281, as seen in the profile view of the strap member 260 in FIG. 32. The angle 287 of these angled engagement surfaces 282E/283E may be at 90 degrees, or may preferably be greater than 90 degrees, to fully facilitate operation of the bumper portion of the pawl/strap combination 210 upon the sash window/door, as seen in FIGS. 38-41, and discussed hereinafter. The strap portion 262 may of course include a series of ratchet teeth, as described previously.

The strap member 260 may be used with the pawl 20 that is shown in FIGS. 4-8, or the strap member 260 may instead be used in combination with pawl 220, as seen in FIG. 29A. Pawl 220 is configured to be enabled to provide additional capabilities, at least one of which may work in combination with the configuration of the strap member 260.

Figure 35A:
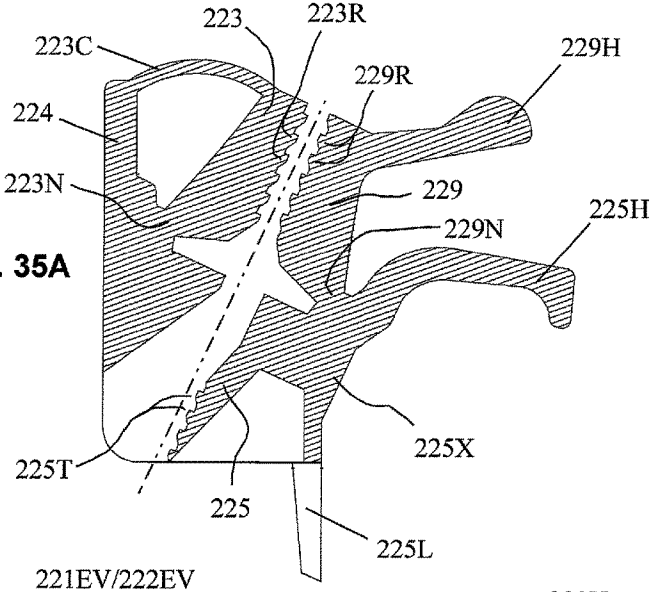
FIG. 35A is a cross-sectional view through the pawl of FIG. 29A.
Figure 35:
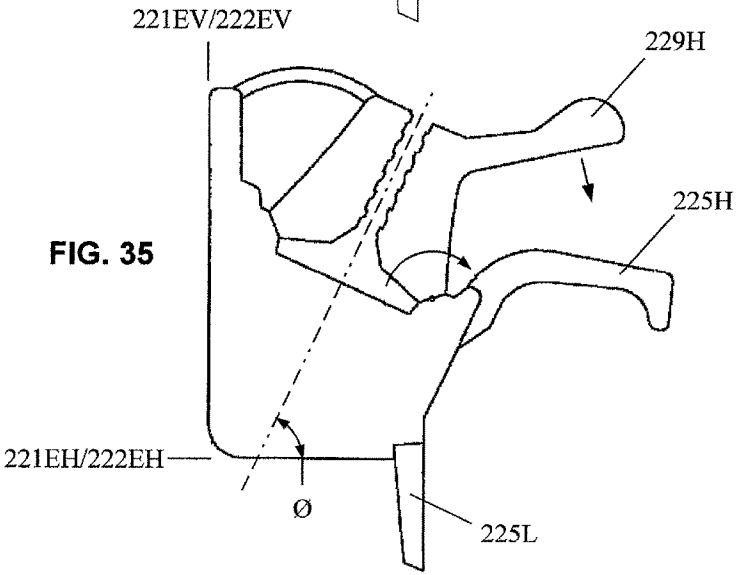
FIG. 35 is a side view of the pawl of FIG. 29A.
Figure 36:
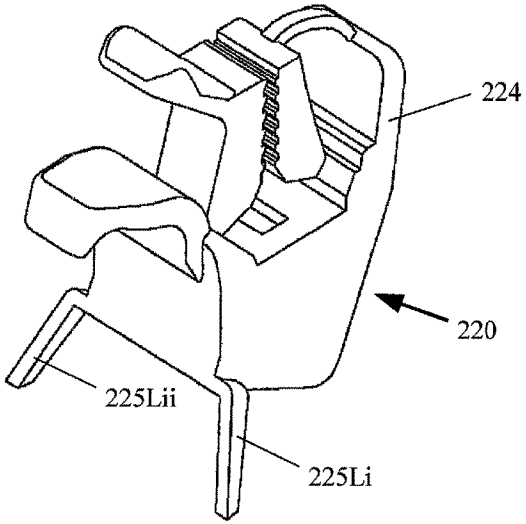
FIG. 36 is a first perspective view of the pawl of FIG. 29A.
Figure 37:
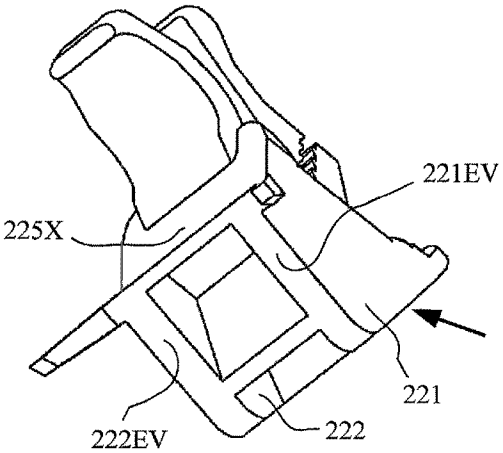
FIG. 37 is a second perspective view of the pawl of FIG. 29A.

Perspective views of the pawl 220 are shown in FIGS. 36 and 37, a side view of the pawl 220 is shown in FIG. 35, and a cross-sectional view of the pawl is shown in FIG. 35A. The pawl 220 may be configured similar to pawl member 20, and may thus be formed with a first side wall 221 and a second side wall 222, both of which may be maintained at a set distance by its connection with "top" wall 224 and intermediate wall 225, which may be integrally formed therewith. First side wall 221 and second side wall 222 may be generally parallel to each other, but need not be so oriented. Also, the first side wall 221 and second side wall 222 may both terminate at a pair of orthogonal engagement surfaces—a vertical engagement surface 221EV and a horizontal engagement surface 221EH for the first side wall 221, and a vertical engagement surface 222EV and a horizontal engagement surface 222EH for the second side wall 222. These corresponding pairs of engagement surfaces may preferably be orthogonal to each other as they may ultimately, when the clip assembly 210 is installed upon a sash window or door to be transported, engage the meeting rail of the lower sash member therein and the stile of the upper sash member, which also will generally have respective perpendicular surfaces.

A protrusion 223 may protrude from the top wall 224, and may have a narrow, necked-down connection 223N therewith, which may permit the protrusion to exhibit some flexible with respect to the top wall 224 and side walls 221/222. An arc-shaped connector tab 223C may be integrally formed with the distal end of the protrusion 223 and may also be formed to interconnect with a portion of the top wall 224, and may thereby serve to temporally provide added stiffness for the protrusion. The protrusion 223 may have a plurality of ratchet teeth 223R formed on an inward facing surface, as seen in FIG. 35A.

An inward facing surface of the intermediate wall 225 may also have a plurality of ratchet teeth 225R be formed thereon. The intermediate wall 225 may diverge outwardly and to an extent whereby it reaches the periphery of the first side wall 221 and second side wall 222, and may thus have an exterior bottom-wall portion 225X, which may provide additional structural integrity for the side walls of the pawl 220. (Note that in one embodiment of the pawl, the exterior bottom-wall portion 225X may be utilized without the intermediate wall 225). A protrusion 229 may protrude from a portion of the wall 225X, and may have a narrow, necked-down connection 229N therewith, which may permit the protrusion to exhibit some flexible with respect to the wall 225 and side walls 221/222. The degree of flexibility may be set by the amount that the protrusion necks down at connection 229N (i.e., the cross-sectional area at the neck), and by the material properties. The protrusion 229 may have a plurality of ratchet teeth 229R be formed on an inward facing surface. As seen in FIG. 35A, the ratchet teeth 229R formed on the inward facing surface of protrusion 229 may be staggered with respect to the plurality of ratchet teeth 223R formed on the inward facing surface of the protrusion 223.

Figure 43:
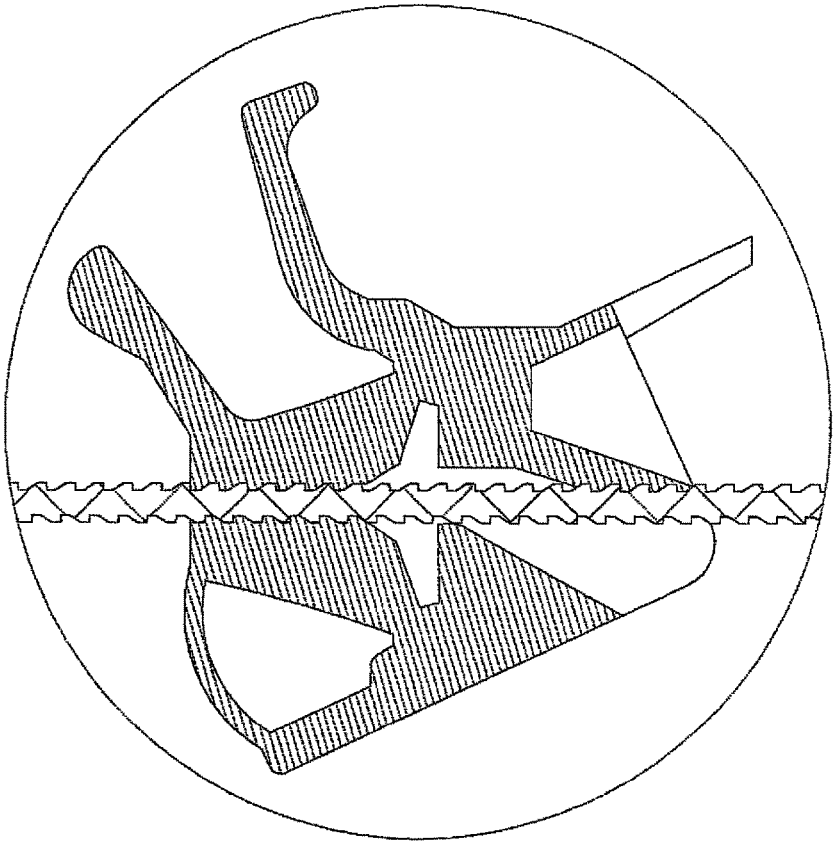
FIG. 43 shows an enlarged detail view of the engagement between the pawl teeth and the strap teeth, as seen in FIG. 42.
Figure 42:
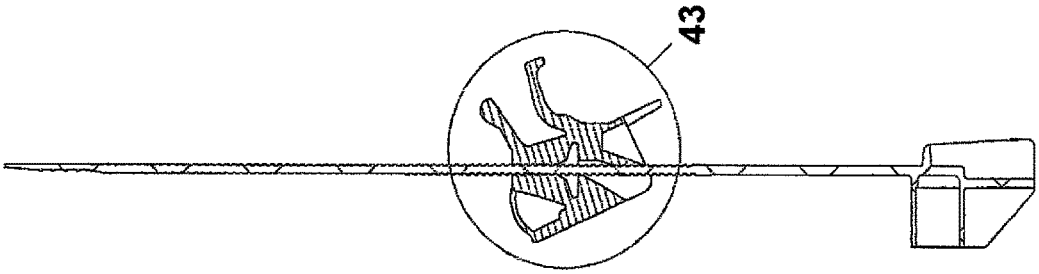
FIG. 42 shows the strap and pawl of FIG. 34, after the pawl teeth have been engaged with the teeth of the strap.

Thus, the strap portion 260S of the strap member 260 may have correspondingly staggered ratchet teeth on its first and second sides (see FIGS. 33 and 34), which are configured to engage the ratchet teeth on protrusions 223 and 229. Also, the plurality of ratchet teeth 225R formed on the intermediate wall 225 and the plurality of ratchet teeth 229R formed on the protrusion 229 may form a gap therebetween that is suitably sized to receive the thickness of the toothed strap portion 260S of the strap member 260. The narrow, necked-down connection 229N of the protrusion 229 with the wall 225 may provide sufficient flexibility to permit the strap to be manually fed between the two protrusions, and to thereafter bias the protrusion 229 into contact with the strap portion 260S to pinch the strap between protrusion 229 and protrusion 223, once the user has ceased applying a force to feed the strap therebetween (see FIGS. 42-43). In order to provide for an even greater engagement force being applied by the protrusions 223 and 229 upon the strap inserted therebetween, the protrusion 229 may be formed to have a nominal, undeformed position be such that it is pivoted to be in closer proximity to protrusion 223 than is shown in FIG. 35A, which may in this embodiment represent positioning of protrusion 229 after the strap has already been inserted and caused some outward deformation. The undeformed position of protrusion 229 may be coordinated with the degree of flexibility created by the neck-down portion, which may be formed to meet minimal stiffness requirements for its biasing to securely engage the strap. A mid-plane between the plurality of ratchet teeth of the two protrusions, represented by the centerline in FIG. 35, may preferably be at an angle θ to the horizontal engagement surfaces 221EH and 222EH of the first and second side walls 221 and 222.

Extending from the distal end of the protrusion 223 and being integrally formed therewith may be a lever arm 229H. The lever arm 22911 may have an integral connection with the protrusion 229 that exhibits greater structural integrity than the protrusion's narrow, necked-down connection 229N with the wall 225. A second lever arm 22511 may similarly extend from the exterior portion 225X of wall 225, and may also be constructed to exhibit greater structural integrity than the narrow, necked-down connection 229N of protrusion 229 with the wall 225.

The pawl 220 may also have a pair of legs 225Li and 225Lii extending from the exterior portion 225X of wall 225, and may extend beyond the horizontal engagement surfaces 221EH and 222EH of the first and second side walls 221 and 222. The legs 225Li and 225Lii may preferably be canted with respect to those engagement surfaces, as seen in FIG. 36, and they may be formed with a very slight cross-section, to not only be flexible, but to also be susceptible to being flattened during installation of the strap member 260, as discussed hereinafter.

Figure 38:
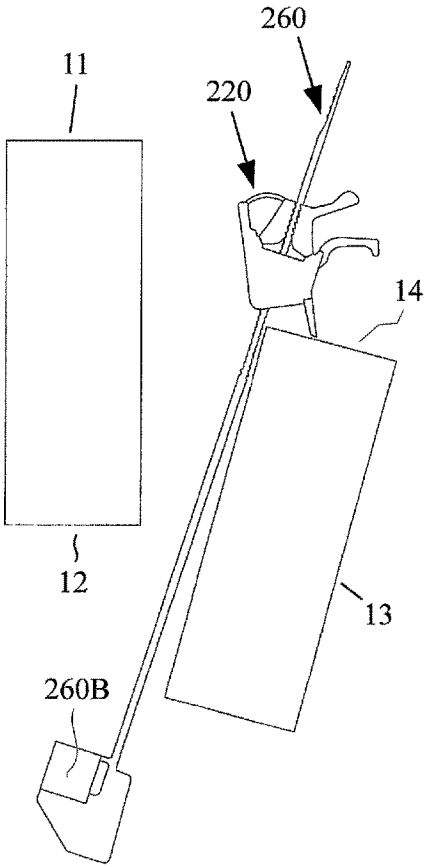
FIG. 38 shows the strap and pawl of FIG. 29A, after the pawl teeth have been engaged with the teeth of the strap, and shown with the bumper portion of the strap having been inserted between the lower tillable sash of a sash window assembly and the upper sash member.

A first step in the installation of the strap member 260 and pawl 220, to form the engaged pawl/strap combination 210 for securing sash members for transport, is shown in FIG. 38. For convenience, as seen therein, the pawl 220 may be pre-set upon the end of the strap portion 262, prior to placing the combination upon the tilted sash window member, as seen in FIG. 38. However, the pawl may alternatively receive the strap through the toothed protrusions at a subsequent step.

Figure 40:
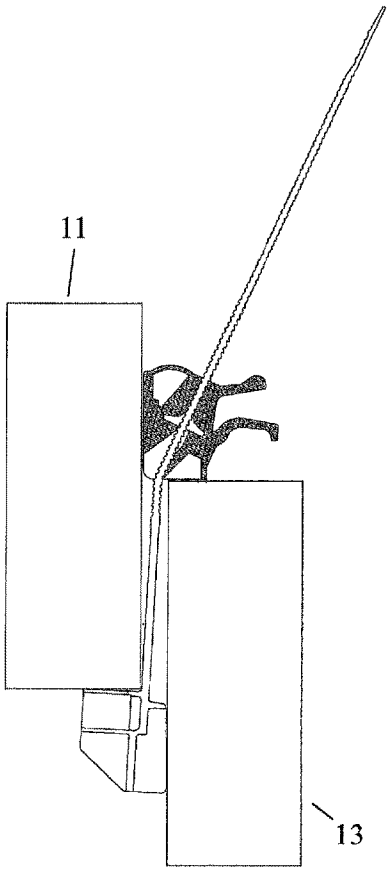
FIG. 40 shows the strap/pawl assembly and the sash window assembly of FIG. 39, after the strap has been pulled through the pawl, to cause the bumper of the strap to contact the meeting rail of the upper sash member, and to cause deformation of the legs of the pawl for engagement of the pawl with the meeting rail of the lower sash member, to secure the sashes relative to each other in the closed position.
Figure 39:
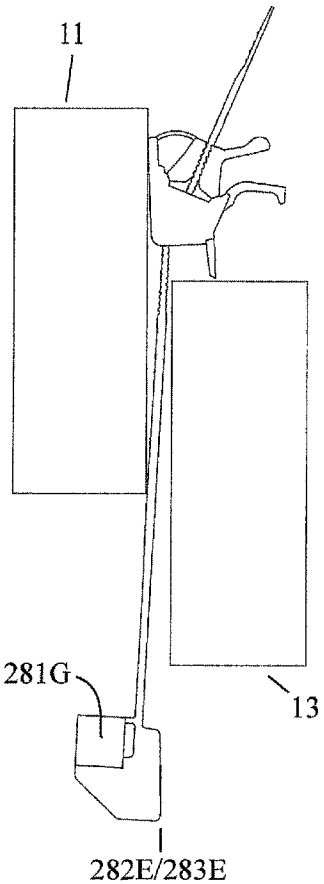
FIG. 39 shows the strap/pawl assembly and the sash window assembly of FIG. 38, after the lower sash has been tilted back upwards towards its engagement with, and retention by the master frame.
Figure 40A:
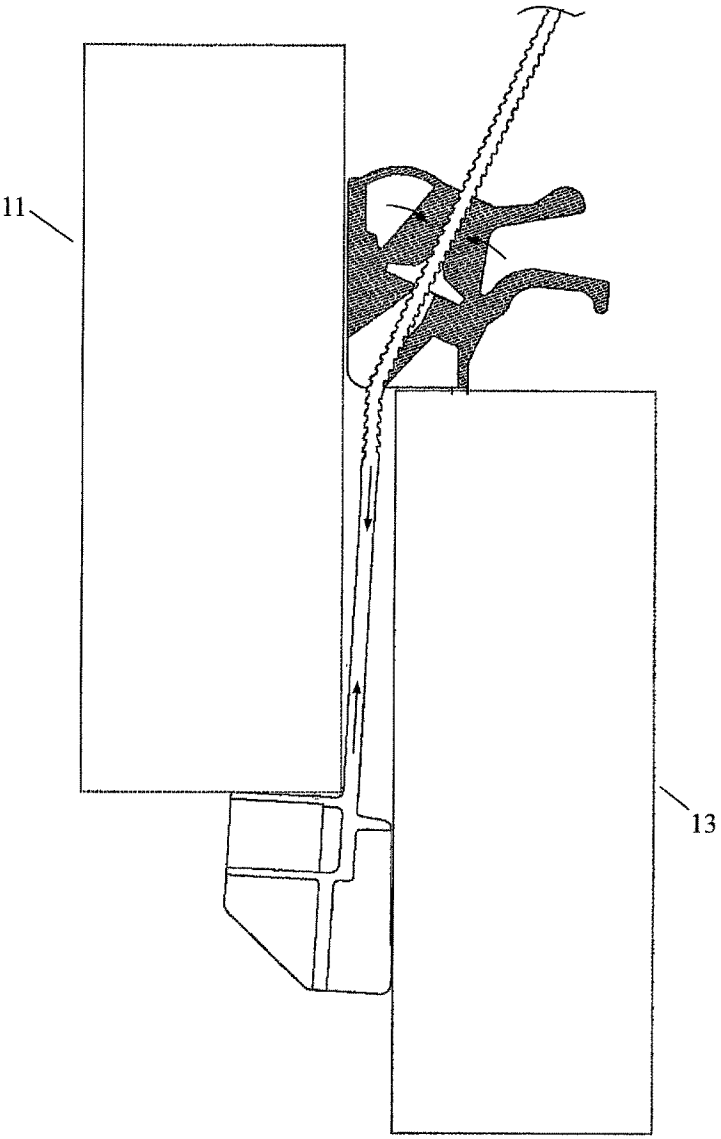
FIG. 40A is an enlarged detail view of the strap/pawl assembly and the sash window assembly of FIG. 40.

With the bumper portion 260B of the strap member 260 positioned below the meeting rail 12 of the upper sash 11, and the pawl 220 positioned above the meeting rail 14 of the lower sash 13, the tilted sash may then be rotated back towards the master frame and secured thereto, as seen in FIG. 39. The strap portion 262 may be pulled through the protrusions 223 and 229 of the pawl 220, so that the angled pair of legs 225Li and 225Lii (when utilized) that extend from the exterior portion 225X of wall 225, contact the meeting rail of the sash 13. Continued pulling of the strap portion 262 through the protrusions 223 and 229 of the pawl 220 may result in the bumper portion 260B of the strap member 260 moving upwardly, with the engagement surfaces 282E and 283E of stiffeners 282 and 283 contacting the side of the meeting rail of sash 13, and the free end of the enclosed geometric shape 281G contacting the bottom of the meeting rail 12 of the sash 11. Further pulling of the strap portion 262 through the protrusions 223 and 229 of the pawl 220 may result in the legs being deformed outwardly, until the pawl/strap combination 210 is completely installed, as seen in FIG. 40, and in the enlarged view of FIG. 40A.

Contact at the bottom of the meeting rail of sash 11 being from the free end of the enclosed geometric shape 281G, rather than from the end where the engagement wall 281 joins the strap portion 262, permits a discrete amount of deformation of the geometric shape. This permits the strap to be incrementally fed (pulled) through the protrusions of the pawl to cause further preloading of the sashes relative to each other and relative to the master frame, as the geometric shape experience increasing deformation. This preloading may also result in residual tension in the strap portion 262, once the pulling has ceased, so that its ratchet teeth are caused to engage with the corresponding teeth of the protrusions 223 and 229, and cause loading of each of the protrusions against the strap, trapping it therebetween.

The disclosed geometry of the strap member 260 and pawl 220 creates an angled orientation for the strap portion 262, upon installation of the pawl/strap combination 210 between the sashes. This serves to not only preload the sashes in opposite directions relative to the master frame in which it slides, to prevent damaging the frame and/or damage to the sash locks which may now be left unlocked during transit, but also serves to cause separation between the sashes and prevent damage from chatter therebetween.

Figure 41:
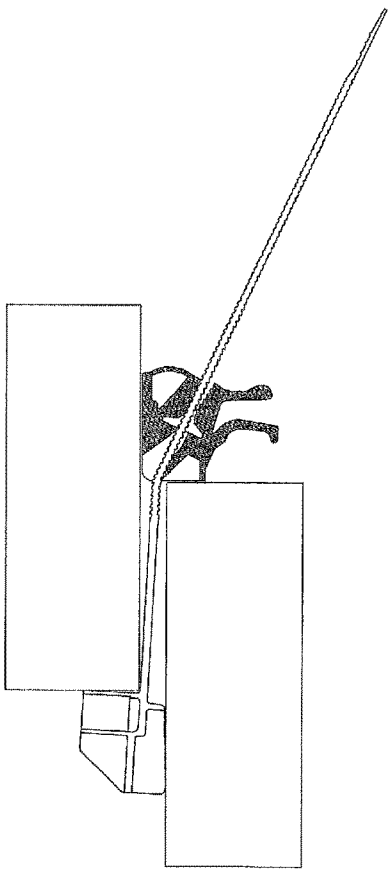
FIG. 41 shows the strap/pawl assembly and the sash window assembly of FIG. 40, but after at least one of the pawl handles has been actuated to release the toothed engagement between the strap and the pawl.

Removal of the pawl/strap combination 210 from between the sashes may be accommodated by the user simply gripping the lever arms 225H and 229H to cause the protrusion 229 to deform and pivot relative to the narrow, necked-down connection 229N, and disengage from the strap portion 262 (see FIGS. 35 and 41). The pawl may then be jockeyed to permit the strap portion 262 to be released and separated therefrom. The protrusion 229 may just deform, or it may be caused to fail at the neck, depending upon several factors, such as, but not limited to, the cross-section utilized, the material's properties, the length of the lever arms and the moment that may be generated, etc. In addition, the arc-shaped connector tab 223C may be severed using a wire cutter or other tool, and the protrusion 223 may be caused to fail by the user first using the lever arm 229H to drive the protrusion 223 counter-clockwise. Also, a handle may additionally be formed on protrusion 223 to assist in its deformation.

Figure 45:
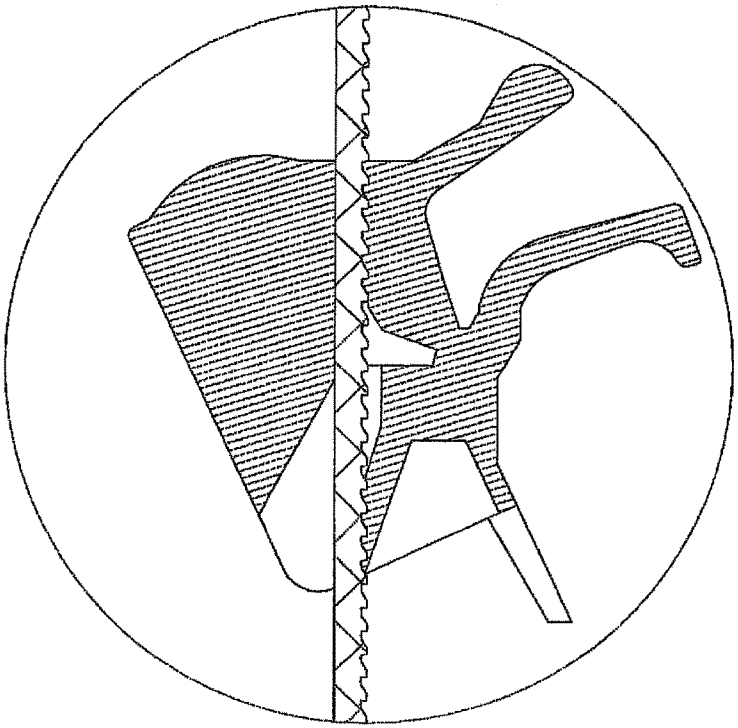
FIG. 45 shows an enlarged detail view of the engagement between the pawl teeth and the strap teeth, as seen in FIG. 44, revealing teeth on only one side of the strap, and also corresponding teeth on only one of the protrusions of the pawl.
Figure 44:
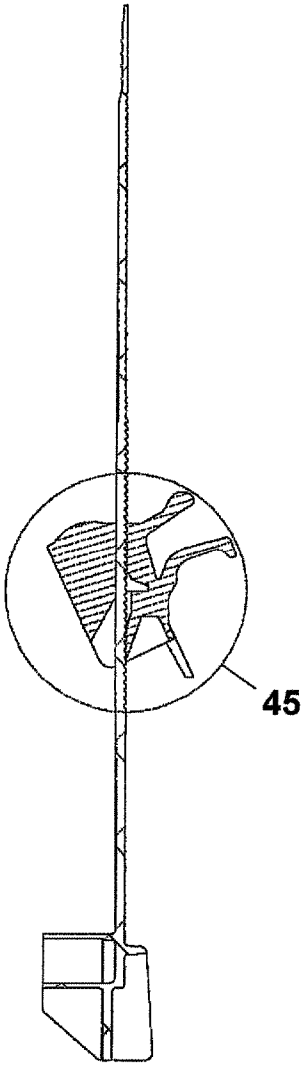
FIG. 44 shows a variation of the strap and pawl of FIG. 34, after the pawl teeth have been engaged with the teeth of the strap.

If a significant amount of tension was utilized to preload the sashes, the teeth of the strap portion 262 may not easily be released from its engagement with the corresponding teeth of the intermediate wall 225, and for that reason, those teeth may be eliminated therefrom, and the ratchet teeth may, in such an alternate embodiment, only be utilized on the protrusions 223 and 229. Furthermore, in another alternate embodiment, the ratchet teeth may only be utilized on one side of the strap and on the corresponding side of the pawl, as shown in FIGS. 44 and 45.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

The invention claimed is:

1. A method of securing a sliding sash window member or sliding sash door member relative to a master frame, for preventing damage during transporting of the sliding sash window member or sliding sash door member, said method comprising:

sliding a first sash member from a closed position into an opened position;

inserting a strap member between a meeting rail of a second sash member and a meeting rail of the opened first sash member, with a bumper portion of the strap member butting against the meeting rail of the second sash member, and a strap portion of the strap member extending beyond the meeting rail of the first sash member;

sliding the first sash member from the opened position back into the closed position;

inserting a free end of the strap portion into an opening of a pawl, with one or more teeth of a plurality of teeth of the strap member engaging one or more corresponding teeth of a plurality of teeth of the pawl;

sliding the pawl towards the meeting rail of the first sash member until the pawl contacts the meeting rail of the first sash member, while maintaining contact between, the bumper portion of the strap member and the meeting rail of the second sash member;

applying a force to the pawl causing a roughly ninety degree rotation of the pawl and a portion of the strap member engaged within the pawl, for leveraging the pawl for producing correspondingly increasing tension in the strap portion between the first sash member and second sash member, and correspondingly increased preload ng of at least the first sash member against the master frame.

2. The method according to claim 1 further comprising releasably securing the pawl and the portion of the strap member engaged within the pawl at said roughly ninety degrees rotation by positioning a protrusion of the pawl within a gap between the meeting rail of the first sash member and the meeting rail of the second sash member.

* * * * *